US008162237B2

(12) United States Patent
DeGrazia, Jr. et al.

(10) Patent No.: US 8,162,237 B2
(45) Date of Patent: Apr. 24, 2012

(54) AIR:FLUID DISTRIBUTION SYSTEM AND METHOD

(75) Inventors: Torey W. DeGrazia, Jr., Park Ridge, IL (US); Margaret Rajski, Ingleside, IL (US)

(73) Assignee: Fuel Management, Inc., Park Ridge, IL (US)

( * ) Notice: Subject to any disclaimer, the term of this patent is extended or adjusted under 35 U.S.C. 154(b) by 0 days.

(21) Appl. No.: 12/759,450

(22) Filed: Apr. 13, 2010

(65) Prior Publication Data

US 2010/0269934 A1 Oct. 28, 2010

Related U.S. Application Data

(63) Continuation of application No. 11/143,524, filed on Jun. 2, 2005, now Pat. No. 7,695,275.

(60) Provisional application No. 60/576,369, filed on Jun. 2, 2004, provisional application No. 60/662,486, filed on Mar. 16, 2005.

(51) Int. Cl.
*F23D 11/46* (2006.01)
*F16K 11/065* (2006.01)
*B05B 7/10* (2006.01)

(52) U.S. Cl. ..... 239/406; 239/414; 137/625.18

(58) Field of Classification Search ..... 137/625.18, 137/595; 239/405, 406, 414
See application file for complete search history.

(56) References Cited

U.S. PATENT DOCUMENTS 622,245 A * 4/1899 Luttrell ..... 239/406
721,900 A * 3/1903 Lassoe et al. ..... 239/406
812,232 A * 2/1906 Rhodes ..... 137/595
1,381,095 A 6/1921 Starr
1,394,900 A * 10/1921 Hibner ..... 137/625.18
1,529,015 A * 3/1925 Dodge ..... 137/625.18
1,590,323 A * 6/1926 Schubert ..... 137/595
1,948,737 A * 2/1934 Stettner ..... 239/414
2,090,267 A * 8/1937 Pulejo et al. ..... 239/414
2,414,442 A * 1/1947 Breault ..... 239/414
2,602,292 A 7/1952 Buckland et al.
2,653,801 A 9/1953 De Gelder et al.
2,870,764 A * 1/1959 Carlson et al. ..... 137/625.18
2,929,442 A 3/1960 Brola
2,959,361 A 11/1960 Lingis
3,267,927 A * 8/1966 Hirschberg ..... 239/405
3,383,049 A * 5/1968 Guerin ..... 239/414
3,404,939 A 10/1968 Saha
3,545,906 A * 12/1970 Meneret et al. ..... 137/625.18
3,726,634 A 4/1973 Thomson et al.

(Continued)

FOREIGN PATENT DOCUMENTS

JP 58018551 A 2/1983

(Continued)

*Primary Examiner* — John Rivell

(74) *Attorney, Agent, or Firm* — Pauley Petersen & Erickson

(57) ABSTRACT

A valve assembly including a block forming a bore. An air inlet opening is in communication with the bore, and provides a volume of air into the bore. The bore provides communication between the air inlet opening and at least one air outlet passage. A fuel inlet opening is in communication with the bore, and provides a volume of fuel into the bore. The bore provides communication between the fuel inlet opening and at least one fuel outlet passage. A pintle is slidably positionable within the bore to control the volume of air directed out of the bore through the air outlet passage and the volume of fuel directed out of the bore through the fuel outlet passage.

11 Claims, 29 Drawing Sheets

U.S. PATENT DOCUMENTS

| | | | | | |
|---|---|---|---|---|---|
| 3,752,188 | A | | 8/1973 | Sage | |
| 3,763,891 | A | * | 10/1973 | Stiltner | 137/625.18 |
| 3,785,570 | A | * | 1/1974 | Krieger | 239/414 |
| 3,841,555 | A | * | 10/1974 | Lilja | 137/625.18 |
| 3,977,604 | A | | 8/1976 | Yokoyama et al. | |
| 4,698,014 | A | | 10/1987 | Grthe et al. | |
| 4,726,686 | A | | 2/1988 | Wolf et al. | |
| 4,728,284 | A | * | 3/1988 | Coppin | 239/414 |
| 4,754,600 | A | | 7/1988 | Barbier et al. | |
| 4,909,933 | A | * | 3/1990 | Carter et al. | 137/625.19 |
| 5,059,357 | A | | 10/1991 | Wolf et al. | |
| 5,281,132 | A | | 1/1994 | Wymaster | |
| 5,322,222 | A | | 6/1994 | Lott | |
| 5,458,136 | A | | 10/1995 | Jasper et al. | |
| 5,681,162 | A | | 10/1997 | Nabors, Jr. et al. | |
| 5,704,551 | A | | 1/1998 | Schmidt et al. | |
| 5,888,059 | A | | 3/1999 | Edwards et al. | |
| 6,077,152 | A | | 6/2000 | Warehime | |
| 6,314,949 | B1 | | 11/2001 | DeGrazia, Jr. et al. | |
| 6,331,109 | B1 | | 12/2001 | Paikert et al. | |
| 6,584,759 | B1 | | 7/2003 | Heap | |
| 6,857,448 | B2 | * | 2/2005 | Schwartzman | 137/625.18 |
| 7,695,275 | B2 | | 4/2010 | DeGrazia, Jr. et al. | |
| 2003/0015596 | A1 | | 1/2003 | Evans | |
| 2004/0025832 | A1 | | 2/2004 | Baasch et al. | |
| 2004/0079417 | A1 | | 4/2004 | Auad | |
| 2005/0002831 | A1 | | 1/2005 | Ashe et al. | |

FOREIGN PATENT DOCUMENTS

| | | | |
|---|---|---|---|
| JP | 62276216 | A | 12/1987 |
| JP | 06002634 | A | 1/1994 |
| JP | 09317482 | A | 12/1997 |
| JP | 10159658 | A | 6/1998 |
| JP | 2000356169 | A | 12/2000 |
| JP | 2003166450 | A | 6/2003 |

* cited by examiner

FIG. 27A
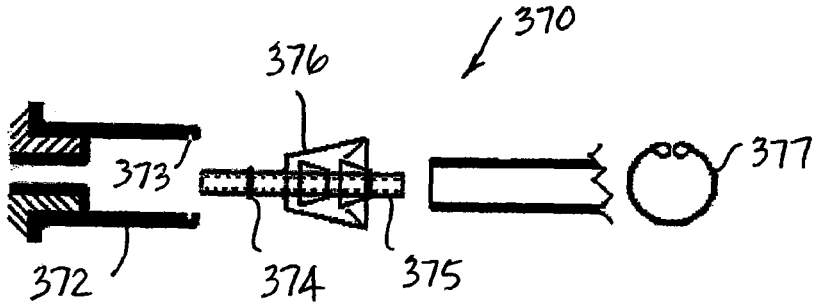
FIG. 27B
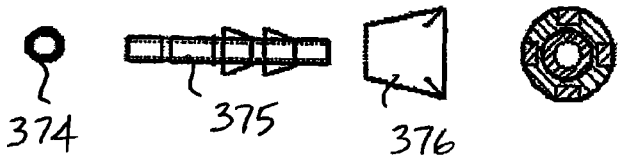
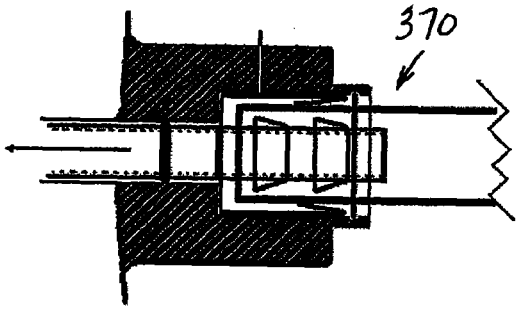
FIG. 27C

FIG. 30A
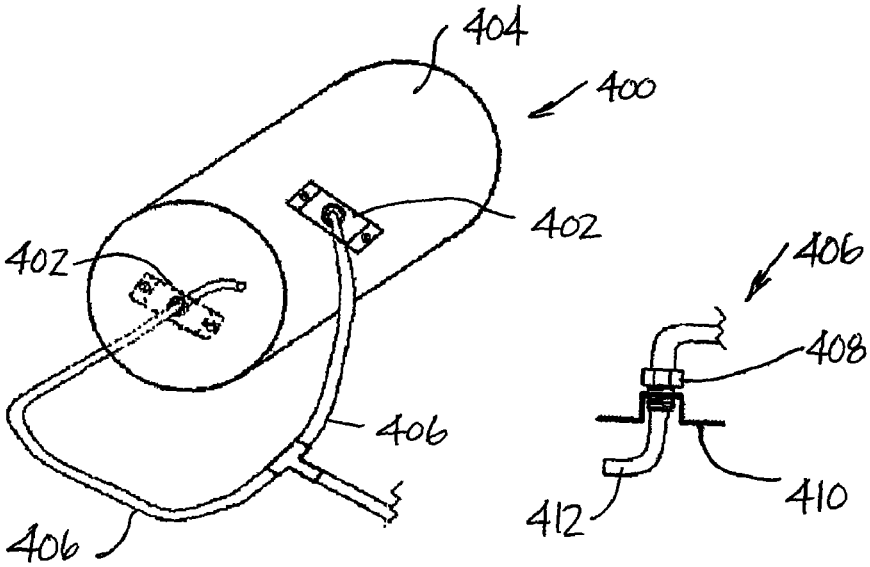
FIG. 30B
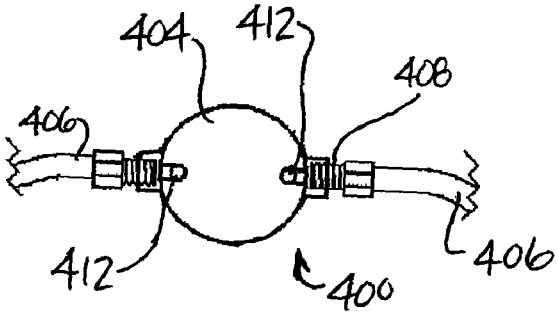
FIG. 30C

AIR:FLUID DISTRIBUTION SYSTEM AND METHOD

CROSS REFERENCE TO RELATED APPLICATIONS

This application is a continuation of U.S. patent application, Ser. No. 11/143,524, filed on 2 Jun. 2005, and issued as U.S. Pat. No. 7,695,275, on 13 Apr. 2010, which claims the benefit of U.S. Provisional Patent Application No. 60/576,369, filed on 2 Jun. 2004, and U.S. Provisional Patent Application No. 60/662,486, filed on 16 Mar. 2005. The co-pending parent application is hereby incorporated by reference herein in its entirety and is made a part hereof, including but not limited to those portions which specifically appear hereinafter.

BACKGROUND OF THE INVENTION

1. Field of the Invention

This invention relates generally to an air: fluid distribution system and, more particularly, to an air:fluid distribution system including a valve assembly that regulates or controls an amount of air and an amount of fluid that enters the valve assembly and/or exits the valve assembly.

2. Description of Related Art

Optimal mixtures are dependent on the provision of an exact amount or volume of two or more fluids (such as air and fuel, pigment and concentrates, or a liquid and powdered mass) and the mixture of the optimized quantities within a flow pattern that enables the required degree of atomization and mixedness. In existing systems, a lack of consistency exists between individual batches (such as paint, processed food, or medicinal mixtures) and within combustion processes for a number of reasons. For example, exact or optimal amounts of fluids are seldom consistently delivered by weight or by volume because of variances in air pressure, humidity and/or temperature. In addition, an incomplete or inexact atomization and mixedness may result from the failure to optimize the momentum and velocity of the air and fluid flow from the point of delivery within a forced swirling vortex. The resulting axial velocity of the air and fluid flow may also be negatively affected by adverse pressure gradients, nozzles and/or friction. In certain configurations, such as those that use fan assemblies, centrifugal rather than centripetal force directs the flow outward to points of dissolution or recirculation rather than inward toward the center. Finally, a turbulent flow rather than a laminar flow is typically used to direct the fluids.

Numerous processes are designed to function with a predetermined theoretical stochiometric amount of air and fluid. While this is especially the case in terms of combustible fluids, this stochiometric or theoretically exact air:fuel ratio is seldom if ever achieved in currently available heating units (including, but not limited to, standard and industrial furnaces, boilers, hot water heaters, dryers, torches, stoves, auxiliary heating devices and heat engines). This occurs for various reasons, including the fact that the flow of the fuel is closely controlled either manually or automatically, while the air required for the purposes of combustion is either unregulated or more loosely regulated than the fuel. In addition, if a greater amount of air is delivered by using a fan or other means, the air flow is delivered to the inlet in a centrifugal rather than a centripetal vortex. As a result, a significant reduction in economy and efficiency occurs as systems draw in ambient air at a less-than-optimal ratio and at a volume and density that is deleteriously affected by changes in temperature, pressure, humidity and altitude, as well as the amount, velocity and momentum of the flow.

In actual combustion processes, a slightly excess amount of air that is greater than the stochiometric amount is required for the more complete combustion of the air:fuel mixture. The optimal amount required for a more complete combustion is dependent on the design and intended use of the burner or unit. Although the amount of oxygen required for a more optimal combustion could be increased by compressing the charge, in the past, the costs associated with supplying compressed air have not been sufficiently low to warrant the development of such a distribution system. In addition, the focus of air:fuel induction systems has been on the required or stochiometric ratio rather than on the ratio necessary to achieve the optimal mixture.

In standard existing heat engines, the amount of oxygen delivered to individual cylinders and the associated turbulence is dependent on speed, and the greatest amount of turbulence occurs with the throttle wide open. Systems that use fans, turbochargers or superchargers to increase the flow of air directed into the intake manifold or engine cylinders create a swirling centrifugal vortex. If the centrifugal vortex extends into each cylinder, the flow is toward the outside rather than the interior of the piston where the mixture would pick up more residual gases acting as insulators. If the amount of the air charge is not regulated, excess boost pressure created by a turbocharger or supercharger must be controlled by a waste gate that is opened mechanically, a vacuum diaphragm or other means. Conventional fuel injection systems typically create a spray that is not effectively mixed with air that is injected or otherwise introduced under greater pressure than the fuel. As a result, the amount of atomization and mixedness is not enhanced to enable a more complete pyrolysis of the mixture.

SUMMARY OF THE INVENTION

It is one object of this invention to provide an improved valve assembly for controlling and/or regulating fluid flow.

It is another object of this invention to provide for the separate regulation, control, and/or optimization of the volume, pressure, temperature, humidity and/or density of two or more fluids.

It is another object of this invention to improve the mixedness and/or atomization of fluids using aerodynamic swirling or staging.

The above and other objects of this invention can be attained through a valve assembly including a block that forms or defines a bore. An air inlet opening communicates with the bore, and provides or directs an amount or volume of air into the bore. The bore provides or allows communication between the air inlet opening and at least one air outlet passage. A fuel inlet opening communicates with the bore, and provides or directs an amount or volume of fuel into the bore. The bore provides or allows communication between the fuel inlet opening and at least one fuel outlet passage. A pintle is slidably positioned within the bore to control the volume of air directed out of the bore through the air outlet passage and/or the volume of fuel directed out of the bore through the fuel outlet passage.

The invention further comprehends a valve assembly including a block that forms or defines a mixing chamber. A pair of air inlet openings are formed in the block and each communicates with the mixing chamber. The air inlet openings are preferably formed in the block tangentially relative to each other to provide or direct an amount or volume of air into the mixing chamber tangentially to create an air flow path including at least one centripetal vortex. An air inlet line is positioned with respect to and connected within each air inlet opening. A fuel inlet opening is formed or defined in the block and in communication with the mixing chamber. A fuel inlet line is positioned with respect to and connected within the fuel inlet opening to provide or direct an amount or volume of fuel into the mixing chamber. Upon mixing of the air and fuel within the mixing chamber, an air:fuel mixture exits the mixing chamber into an outlet passage in communication with the mixing chamber.

The invention still further comprehends a valve assembly including a block forming or defining a mixing chamber. An air inlet opening is formed or defined in the block and in communication with the mixing chamber. An air inlet line is positioned with respect to and connected within the air inlet opening to provide or direct an amount or volume of air into the mixing chamber. A fuel inlet opening is formed or defined in the block and in communication with the mixing chamber. A fuel inlet line is positioned with respect to and connected within the fuel inlet opening to provide or direct a volume of fuel into the mixing chamber. The valve assembly includes a rotatable metering wheel that includes or forms a plurality of air passages each having a different opening area or diameter and a plurality of fuel passages each having a different opening area or diameter. The metering wheel is selectively rotatable to align one air passage with the air inlet opening and one fuel passage with the fuel inlet opening. Preferably, the selected air passage having the selected opening area or diameter is associated or aligned with a fuel passage having a corresponding opening area or diameter to provide for a proper or selected air-to-fuel ratio. The metering wheel controls the volume of air entering the mixing chamber and the volume of fuel entering the mixing chamber.

As used herein, references to "fluid" are to be understood to refer broadly to any aggregate of matter or material that flows, including but not limited to any combustible or noncombustible liquid, solid, particle, gas, vapor, plasma, mixture or admixture.

Further, references herein to "fuel" are to be understood to refer broadly to any natural gas, gasoline, diesel, hydrogen, biodiesel, ethanol, or other combustible fuels, mixtures or admixtures thereof, that require the influx of air or two or more fluids for the purposes of combustion.

Other objects and advantages of the invention are apparent to those skilled in the art, in view of the following detailed description taken in conjunction with the appended claims and drawings.

BRIEF DESCRIPTION OF THE DRAWINGS

FIGS. 27A-27C show a self-locking hose connection, according to one preferred embodiment of this invention;

FIGS. 30A-30C show an air-assisted flue pipe, according to one preferred embodiment of this invention.

DETAILED DESCRIPTION OF THE INVENTION

Figure 1:
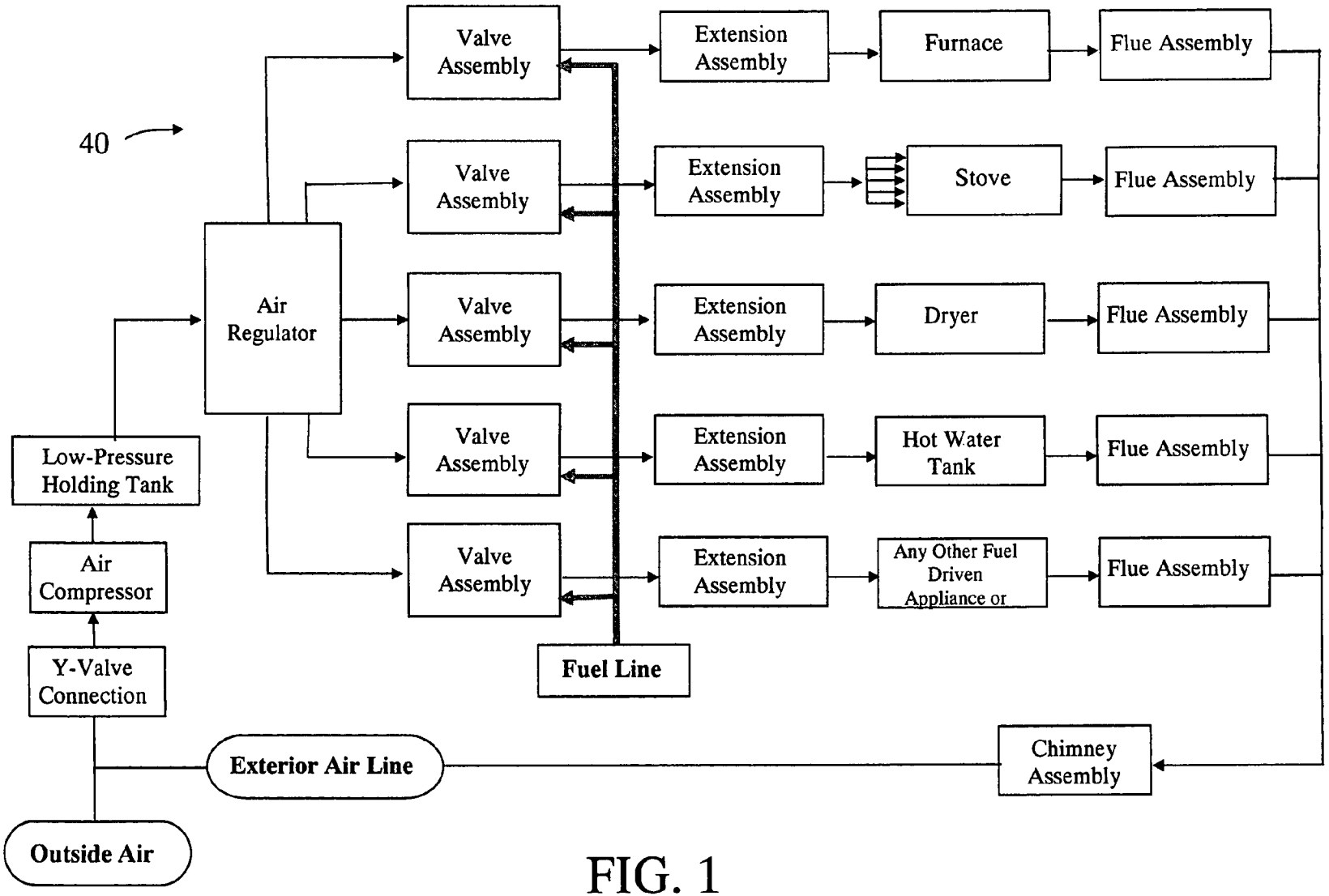
FIG. 1 is a flowchart diagram of an air:fuel distribution system having a modular configuration designed to manage multiple appliances, according to one preferred embodiment of this invention.

Referring generally to FIG. 1, an Air:Fluid Distribution System, such as Air:Fuel Distribution System 40 and method of the present invention optimizes the efficiency and economy of heating units, heat engines and/or other devices or processes that require the delivery of an amount of two or more fluids at a regulated pressure to enhance the atomization, mixedness and/or configuration of the charge or mixture. Preferably, the system and method provide delivery of an exact, optimal or desired amount of two or more fluids at an exact, optimal or desired pressure. The system may include a Vortex-T valve assembly, a Centripetal Injection Device (CID), a CID/Fuel Injector device, and/or a multi-stage valve assembly. Additionally, the system may include optional components including, but not limited to, a metering valve, one or more valve extensions, a burner assembly, a flue/chimney exhaust collector, one or more suitable connectors, and/or controls. The system may function either in a modular manner or as a means of addressing the requirements of a single unit. Preferably, a low-pressure compressor or a forced-air assembly is used to direct air into the valve assembly or connected metering valve, and mix two or more fluids within a centripetal vortex or vortices.

In terms of combustible fluids, the design of the valve assembly of the present invention is based on vortexual combustion engineering and aerodynamic air staging, as well as the optimization and separate management of the pressure, volume, and/or temperature of the incoming air and the incoming fuel. In one preferred embodiment of this invention, the air ($Fluid_1$) and fuel ($Fluid_2$) mixture is based on an optimized stochiometric ($\Phi$) ratio and is ignited and burned within a fuel-rich inner vortex>$F_2$ and leaner outer vortex>$F_1$ (i.e., a vortex-within-a-vortex). In another embodiment of the valve assembly, the pyrolysis is more equally distributed within a fuel-rich>$F_2$ inner vortex and similarly formed fuel-rich $F_2$ outer vortex. In these embodiments, the vortices are axis-symmetric and exhibit a laminar flow along an apparent flame-free interior core that runs through the center of the vortices. Alternatively, combustion occurs in one or more separate vortices that are individually axis-symmetric and exhibit a laminar flow. The system of the present invention results in a significant increase in fuel efficiency or fuel economy and a decrease in regulated emissions.

In addition, the distribution system of the present invention further increases the efficiency and fuel economy losses by thoroughly atomizing and mixing the air and fluid within a centripetal whirling vortex. As previously indicated, conventional fans and turbines used to enhance the operation of heating units and engines direct the air by using a centrifugal vortex. Within a centripetal vortex, the air and fluid mixture converges at the point of discharge and can be more easily directed into an inlet. By using an optimal air:fluid ratio at a constant pressure, the distribution system of the present invention effectively improves the associated process and reduces emissions associated with the use of a nonoptimal mixture.

While the Air:Fluid Distribution System as described herein focuses on the use of a valve assembly for mixing air and a combustible fuel for use in heating units (including, but not limited to, hot water heaters, dryers, furnaces, stoves and boilers) and heat engines, the system and method of the present invention may also be used to mix other fluids for other purposes as will be apparent to those skilled in the art and guided by the teachings herein provided. For example, in one preferred embodiment of this invention, the CID valve assembly may be constructed in a manner to be used in a flame to fluid contact. First a stream of forced air is injected into a vessel or container then the fuel is injected and ignited to provide direct contact with the fluid. Distribution system 40 of the present invention preferably provides centripetal vortexing combustion of combustible fluids resulting in reduced pollutant emissions, improved thermal efficiency, and/or the optimization and/or separate management of pressure, volume, and/or temperature of the inlet air and fuel.

Depending on the configuration of the associated unit, system, apparatus and/or process, the assemblies according to preferred embodiments of this invention described herein may be used to manage air, fluid, or air and fluid, and may be scaled up or down to meet the individual requirements of a specific unit, system, apparatus and/or process.

Referring to FIGS. 2-6, in one preferred embodiment of this invention, an air:fluid distribution system 40 includes a valve assembly 42, referred to as a Vortex-V valve assembly. Valve 42 includes a valve block 44 that forms or defines a bore 46. Preferably, but not necessarily, bore 46 extends along a longitudinal axis 47 of block 44. In one preferred embodiment of this invention, block 44 includes a plurality of removable and selectively positionable modular blocks, shown as 44A, 44B, 44C, 44D and 44E in FIG. 2. Block 44 may include any suitable number of modular blocks, depending upon the application of valve assembly 42 and whether block 44 manages or controls the flow of air, the flow of fluid or the flow of air and fluid. For example, with valve assembly 42 controlling only the flow of air through block 44, valve assembly 42 may include modular blocks 44A, 44C, 44D and 44E. Block 44 also allows or enables valve assembly 42 to be easily maintained and/or upgraded by the installation of a new or refined pintle, discussed below.

As shown in FIGS. 2, 4A, 5 and 6, valve assembly 42 includes at least one air inlet opening 48 that extends into or is formed in block 44 and in communication with bore 46 to provide or direct a volume of air or other suitable gas or fluid into bore 46. Preferably, air inlet opening 48 provides or directs pressurized, compressed or forced air into mixing chamber 45. At least one air outlet passage 50 extends through or is formed in block 44. Air outlet passage 50 is in communication with bore 46 such that bore 46 provides or allows communication between air inlet opening 48 and air outlet passage 50.

Figure 2:
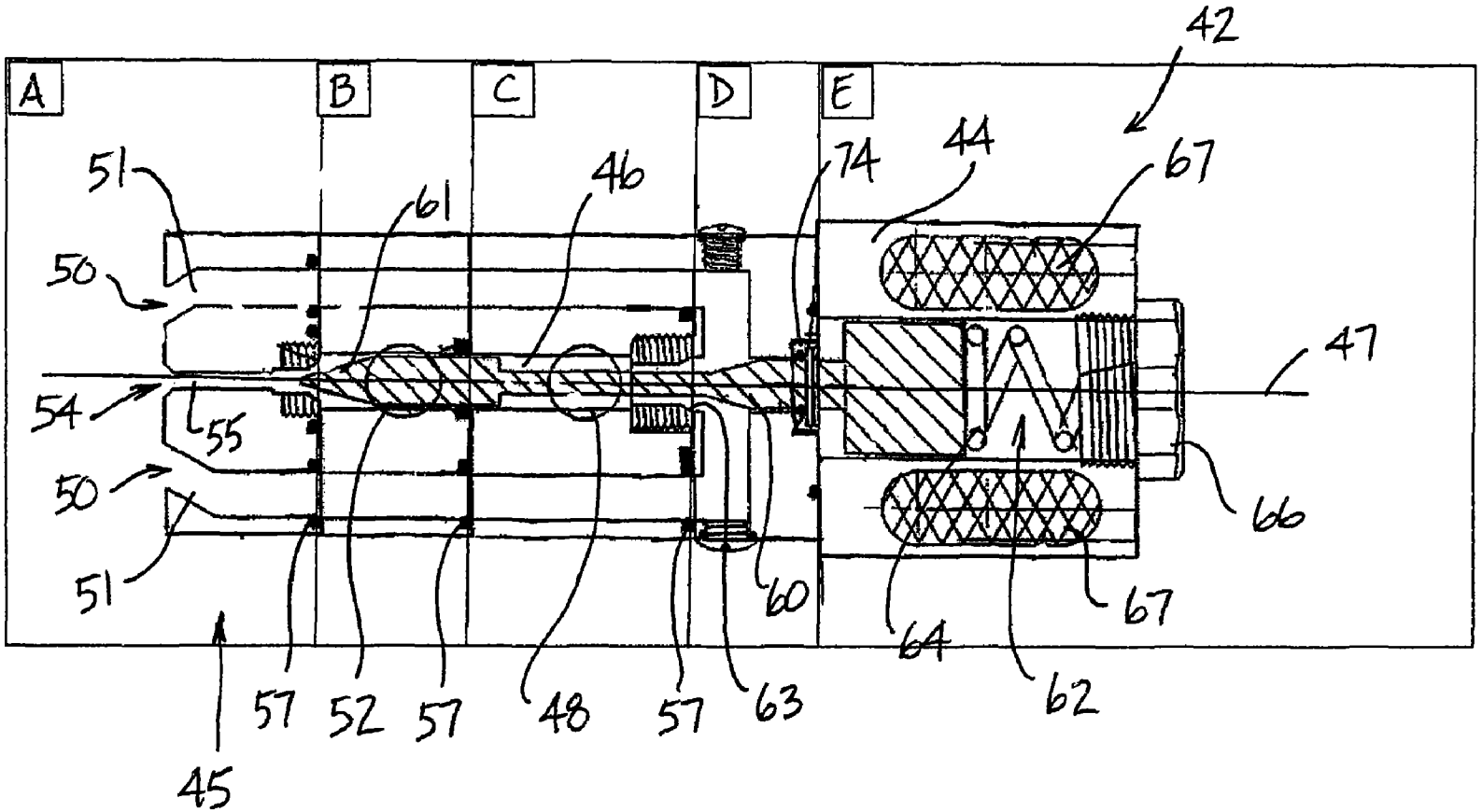
FIG. 2 is a partial sectional side view of an electrically operated valve assembly having air outlet passages and a single-stage pintle, according to one preferred embodiment of this invention.
Figure 4A:
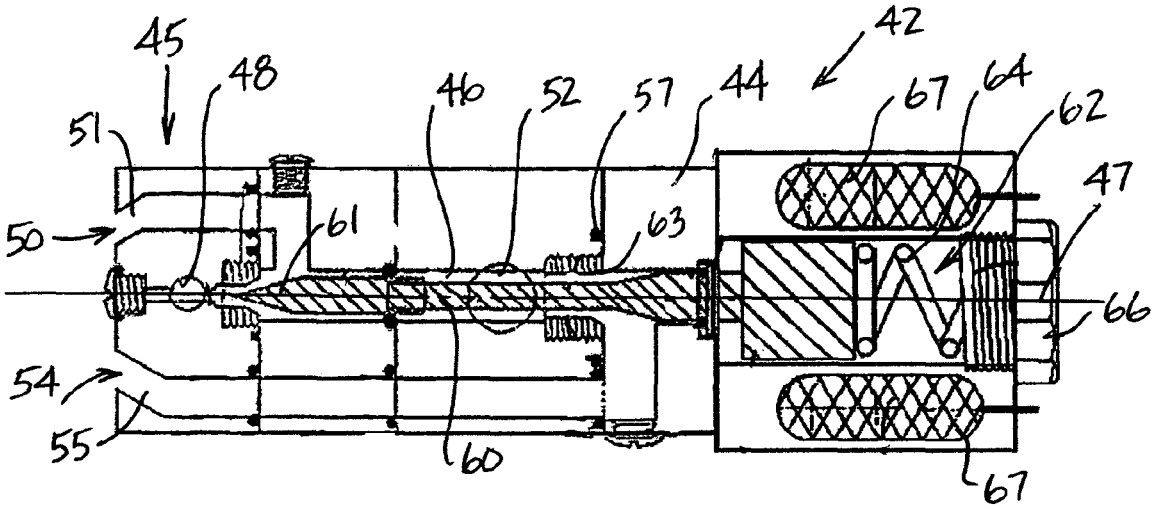
FIG. 4A is a partial sectional side view of an electrically operated valve assembly having an angled air outlet passage and an angled fuel outlet passage, according to one preferred embodiment of this invention.

Similarly, as shown in FIGS. 2, 4A, 5 and 6, at least one fuel inlet opening 52 extends into or is formed in block 44 and in communication with bore 46 to provide or direct a volume of fuel into bore 46. At least one fuel outlet passage 54 extends into or is formed in block 44. Fuel outlet passage 54 is in communication with bore 46 such that bore 46 provides or allows communication between fuel inlet opening 52 and fuel outlet passage 54. As shown in FIG. 2, fuel outlet passage 54 is preferably coaxial with bore 46. Alternatively, as shown in FIG. 4A, fuel outlet passage 54 may extend radially outwardly from bore 46 to extend along a side wall of block 44 to exit block 44 at an outlet end portion 45 of block 44.

In one preferred embodiment of this invention with fuel outlet passage 54 generally coaxial with longitudinal axis 47 of block 44, an end portion 51 of air outlet passage 50 is angled toward an end portion 55 of outlet passage 54, as shown in FIG. 2. In an alternate preferred embodiment of this invention with fuel outlet passage 54 positioned at a distance from longitudinal axis 47, end portion 51 and end portion 55 each converges or is angled towards longitudinal axis 47, as shown in FIG. 4A.

In one preferred embodiment of this invention, as shown in FIG. 2, air enters valve assembly 42 through air inlet opening 48 in modular block 44C. Fuel enters valve assembly 42 through fuel inlet opening 52 in modular block 44B. Preferably, the air and fuel enter valve assembly 42 generally simultaneously, under pressure, and at a precise or exact measured amount. Upon actuation of a pintle 60, discussed below, pintle 60 is moved to an actuated position to allow the release of the air and the fuel. The air moves through air outlet passages 50 and exits valve assembly 42 through angled end portions 51, independently of the fuel flow through block 44. The fuel moves through fuel outlet passage 54 and exits valve assembly 42 through end portion 55. Due to the design of valve assembly 42, the movement or flow of the air and/or the movement or flow of the fuel is restricted within valve assembly 42. More specifically, with valve assembly 42 managing or controlling the movement or flow of air and fuel, the air and fuel do not mix within valve assembly 42. The air and/or fluid may be directed from valve assembly 42 into a single tube or pipe, or into separate tubes or pipes.

For example, as shown in FIG. 2, fuel is discharged from valve assembly 42 through centrally located fuel outlet passage 54, and the air is discharged from valve assembly 42 from two air outlet passages 50 at an angle towards centrally located fuel outlet passage 54. In this embodiment, the air and fuel are mixed at the point of discharge into an extension or mixing chamber (not shown). In the embodiment shown in FIG. 4A, air outlet passage 50 and fuel outlet passage 54 are directed into an extension or the mixing chamber (not shown) at a converging angle towards longitudinal axis 47 of block 44. In one preferred embodiment of this invention, each air outlet passage 50 extends tangentially into an extension or mixing chamber (not shown) and tangentially relative to each other.

Referring further to FIGS. 2, 4A, 5 and 6, valve assembly 42 includes pintle 60 that is slidably movable and positionable within bore 46. Pintle 60 preferably controls or limits the volume of air leaving or directed out of bore 46 through air outlet passage 50 and/or the volume of fuel leaving or directed out of bore 46 through fuel outlet passage 54. Preferably, but not necessarily, pintle 60 is actuatable to move within bore 46, and upon actuation of pintle 60 the volume of air and the volume of fuel enter and/or exit bore 46 simultaneously at desired flow rates. Upon actuation of pintle 60, an air:fuel mixture exits valve assembly 42 into a mixing cylinder or chamber or the air and fuel exit valve assembly 42 separately or independently, as discussed in greater detail below. If the air and fuel are discharged directly into an extension or mixing chamber, the air:fuel mixture is force swirled at or near outlet end portion 45 of valve assembly 42 in a centripetal vortex or vortices. If the air and fuel are discharged into separate outlets, valve assembly 42 may be connected to a second valve, such as a CD valve assembly. In one preferred embodiment of this invention, the air and/or fuel entering valve 42 is controlled by a multi-stage valve assembly, described below.

In one preferred embodiment of this invention, pintle 60 is movable within bore 46 between an initial position and an actuated position. In the initial position, pintle 60 prevents or limits communication between bore 46 and air outlet passage 50 and/or bore 46 and fuel outlet passage 54. With pintle 60 in the actuated position, pintle 60 provides or allows communication between bore 46 and air outlet passage or passages 50 and/or bore 46 and fuel outlet passage 54, as shown in FIGS. 2 and 4A.

Preferably, a retainer 62, such as a spring 64, urges pintle 60 towards the initial position, and thus prevents or limits communication between bore 46 and air outlet passage 50 and/or bore 46 and fuel outlet passage 54. A lock nut 66 or other suitable fastener is positioned at an end portion of bore 46 to securely position retainer 62 within a portion of bore 46. It is apparent to those skilled in the art and guided by the teachings herein provided that retainer 62 can include any suitable component that urges pintle 60 towards the initial position to prevent or limit such communication. Similarly, any suitable fastener can be used to secure retainer 62 within bore 46 and maintain a suitable biasing force to urge retainer 62 against pintle 60, as desired.

In one preferred embodiment of this invention, a solenoid 67 is used to control the flow of air and/or fuel into valve assembly 42. Solenoid 67 is in actuating control communication with pintle 60, and is actuatable to move pintle 60 between the initial position and the actuated position.

O-rings 57 or other suitable gasket or sealing components can be used to form a tight seal between components of the valve assembly, such as between modular blocks that connect air outlet passage 50 and/or fuel outlet passage 54 to bore 46. In one preferred embodiment of this invention, pintle 60 is secured by o-rings 57, a lock-nut seating arrangement, and retainer 62 or other locking arrangement. Valve assembly 42 is sealed by lock nut 66 at an end portion of valve assembly 42, as shown in FIG. 2.

With valve assembly 42 in an initial or off position, pintle 60 is biased in position by retainer 62. Upon activation of solenoid 67, retainer 62 is compressed to allow pintle 60 to move within bore 46 and thereby enable pressurized air and/or fuel to enter valve assembly 42 through air inlet opening 48 and fuel inlet opening 52, respectively. With valve assembly at static state, retainer 62 is released and urges pintle 60 against a seat 63 formed within block 44 to provide a seal and prevent or limit air flow and/or fuel flow through valve assembly 42. Preferably, valve assembly 42 is electrically connected to controls for a heating unit, such as a hot water heater, a furnace or a dryer.

In alternate preferred embodiments of this invention, in the initial position, pintle 60 prevents or limits communication between air inlet opening 48 and bore 46 and/or fuel inlet opening 52 and bore 46. With pintle 60 in the actuated position, pintle 60 provides or allows communication between air inlet opening 48 and bore 46 and/or fuel inlet opening 52 and bore 46.

Preferably, at least a portion of pintle 60 is tapered. The tapered portion of pintle 60 regulates and/or controls the volume of incoming air while a second portion of pintle 60 regulates and/or controls the volume of incoming fuel. An exact or desired quantity of the air and/or fuel drawn into and through valve assembly 42 is controlled by pintle 60 to permit the distribution of an optimal air-to-fuel ratio requirement of a unit or apparatus, such as a burner. In one preferred embodiment of this invention, pintle 60 has a constant angle taper 61, as shown in FIG. 2 for example. With a constant angle taper pintle 60, a quantity of fuel delivered through bore 46 is directly proportional to a quantity or amount of air flow through bore 46, and the resulting air:fuel mixture will be generally constant and approach, and preferably reach, an optimal air-to-fuel ratio.

Figure 3:
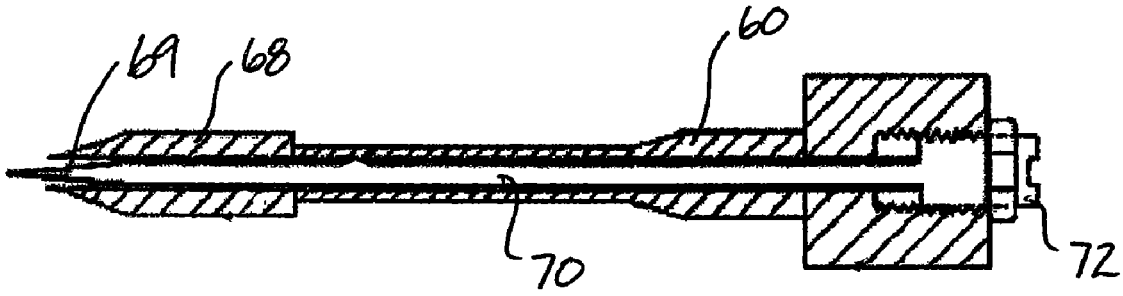
FIG. 3 is a partial sectional side view of a two-stage pintle having an adjustable needle, according to one preferred embodiment of this invention.

In one preferred embodiment of this invention, valve assembly 42 includes a two-stage pintle 60, as shown in FIG. 3, to provide a more precise regulation and/or control of the air:fuel mixture. Two-stage pintle 60 includes an outer housing 68 having a constant angle taper and forming a bore 69. A needle 70 is slidably movable and positionable within bore 69. An adjustment screw 72 is connected to an end portion of needle 70 to adjust a position of needle 70 within bore 69.

Figure 7:
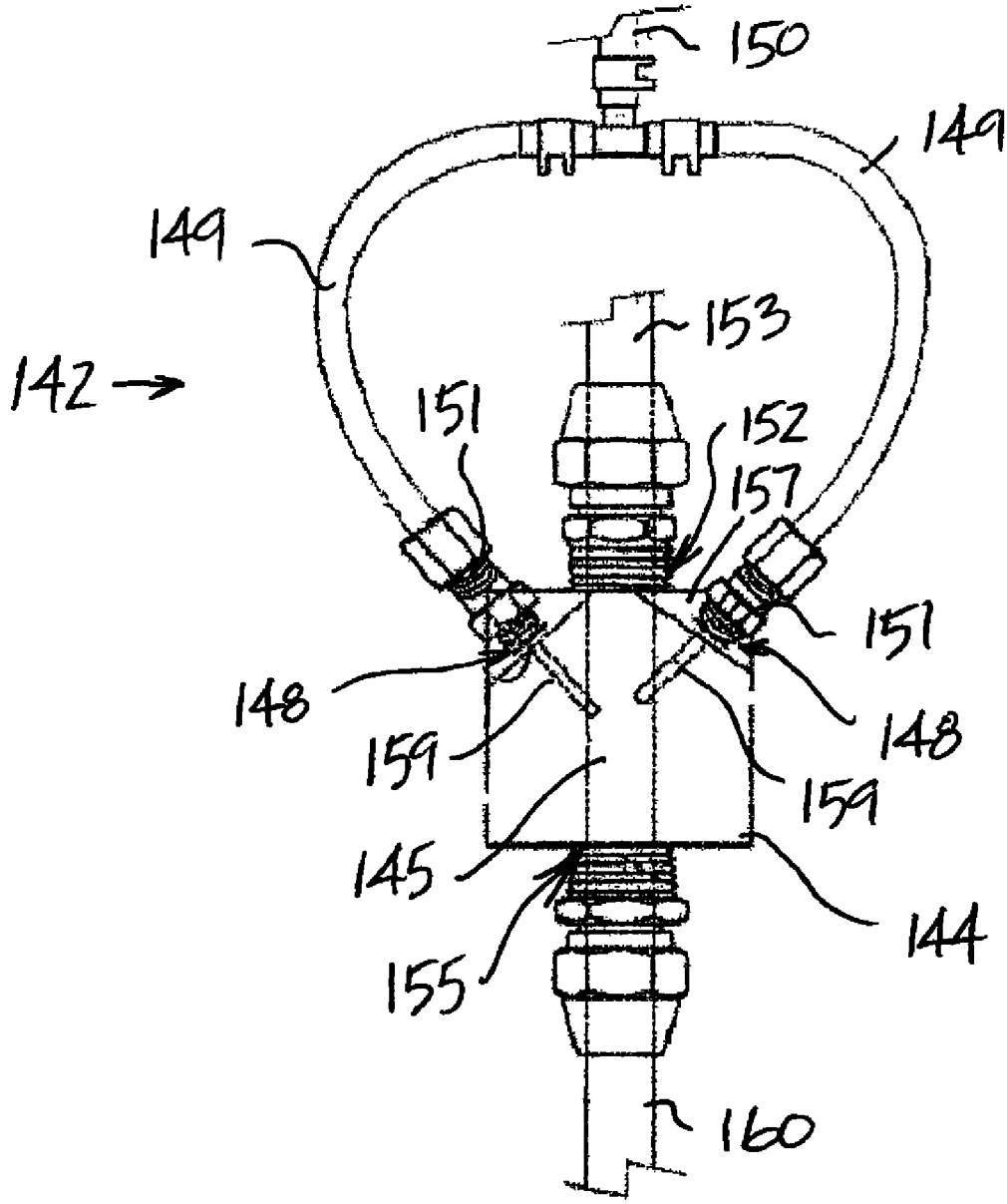
FIG. 7 is a front view of a valve assembly, according to one preferred embodiment of this invention.
Figure 8A:
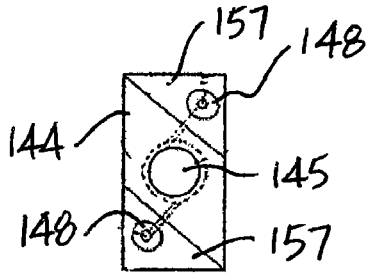
FIG. 8A is a top view of a valve assembly, according to one preferred embodiment of this invention.
Figure 8B:
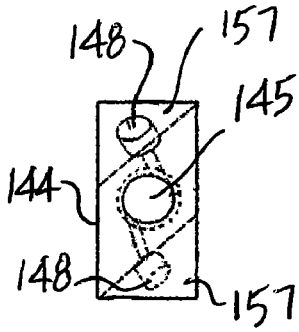
FIG. 8B is a bottom view of the valve assembly of FIG. 8A.
Figure 8C:
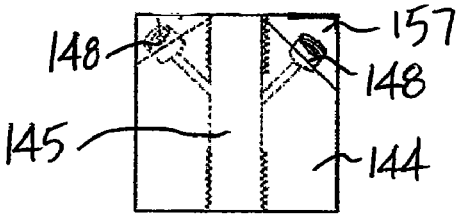
FIG. 8C is a front view of the valve assembly of FIG. 8A.
Figure 8D:
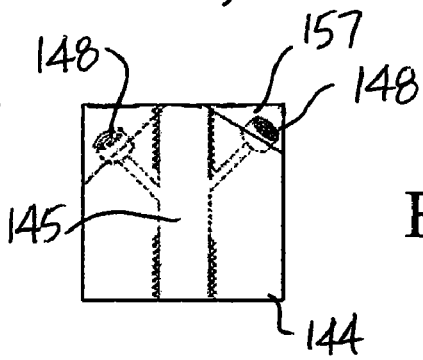
FIG. 8D is a back view of the valve assembly of FIG. 8A.
Figure 8E:
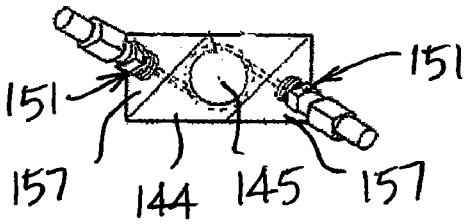
FIG. 8E is a perspective top view of the valve assembly of FIG. 8A.
Figure 8F:
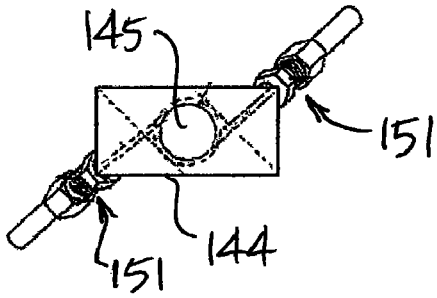
FIG. 8F is a perspective bottom view of the valve assembly of FIG. 8A.
Figure 20:
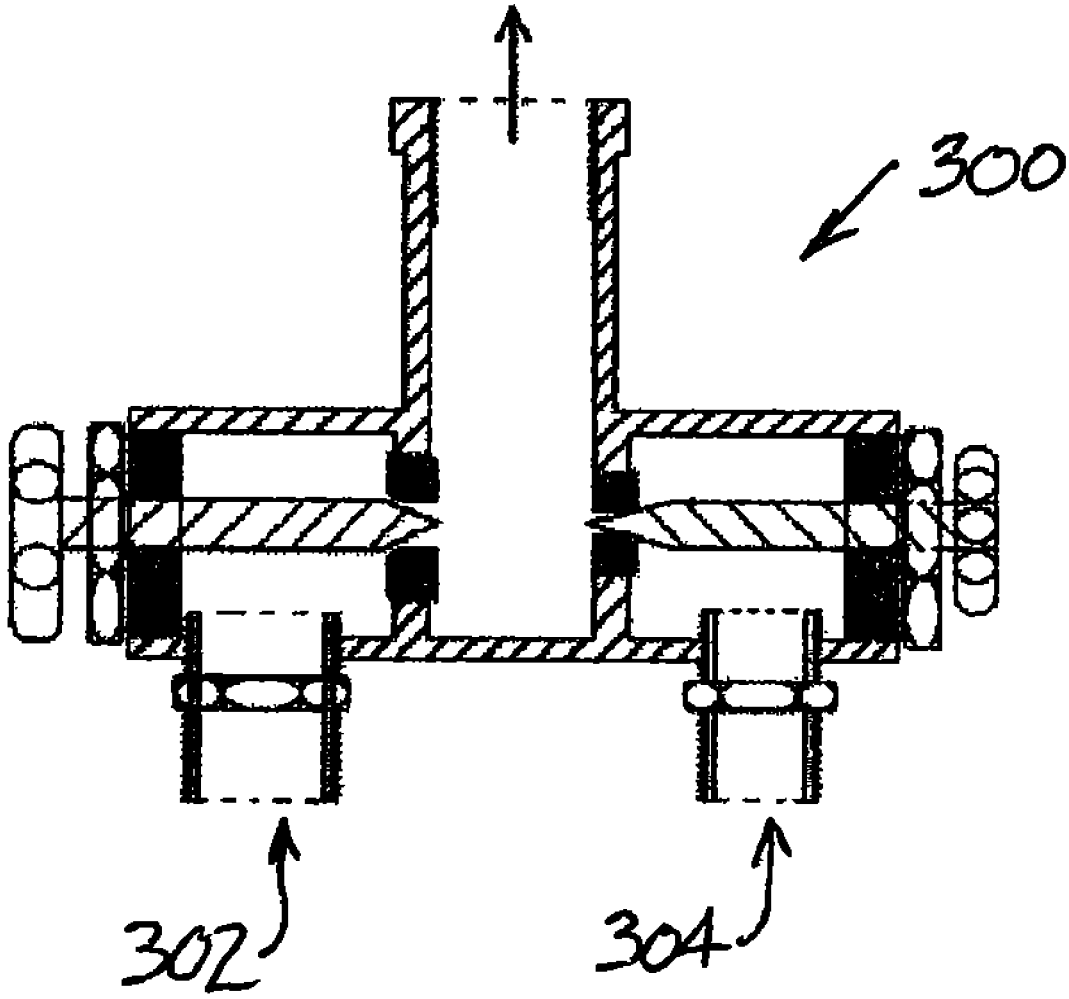
FIG. 20 is a partial sectional side view of a fuel and air mixing valve, according to one preferred embodiment of this invention.
Figure 21A:
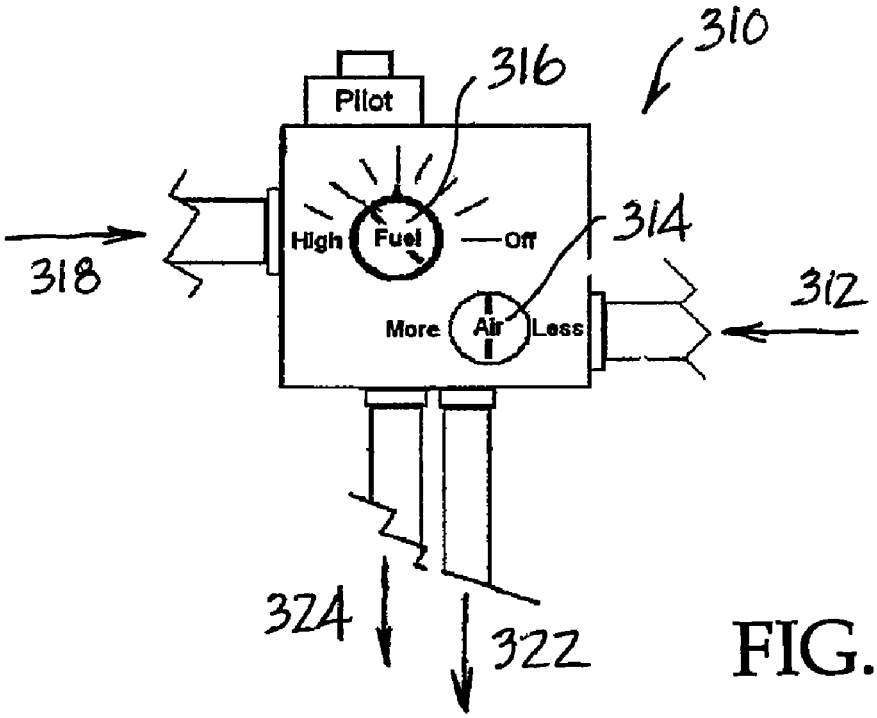
FIG. 21A is a front view of an air:fuel metering valve having an adjustable air controller and an adjustable fuel controller, according to one preferred embodiment of this invention.
Figure 21B:
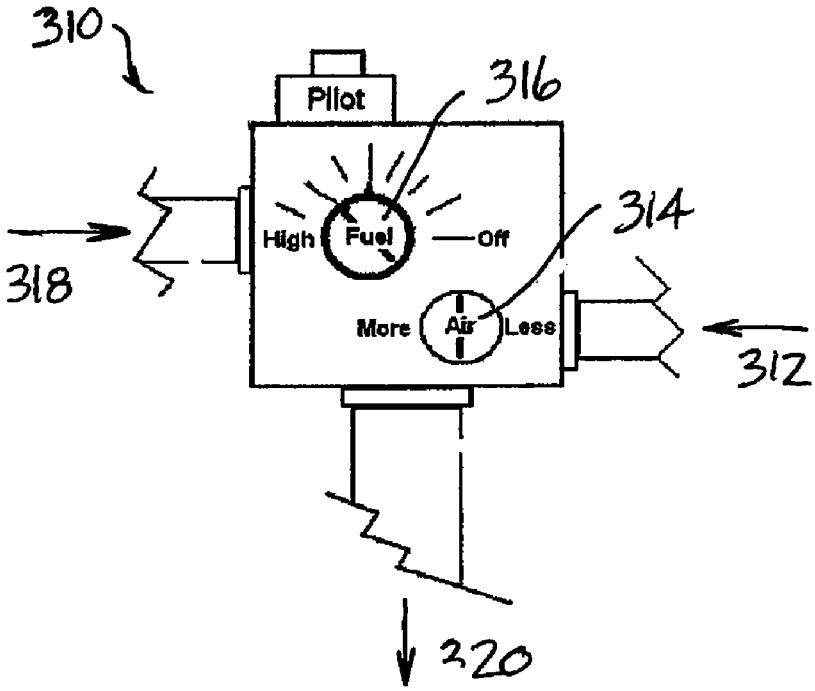
FIG. 21B is a front view of an air:fuel metering valve having an adjustable air controller and an adjustable fuel controller, according to one preferred embodiment of this invention.

Valve assembly 42 separately regulates the volume of air and fuel that enters valve assembly 42. Depending on the configuration of valve assembly 42, the air and/or fuel can be discharged from valve assembly 42 under different respective pressures into an extension or mixing chamber or separate pipes or tubes. If the air and fuel are discharged directly into an extension or mixing chamber, the mixture is force swirled at the outlet in a centripetal vortex or vortices. If the air and fuel are discharged into separate outlets, valve assembly 42 may be connected to a CID valve assembly, as shown in FIG. 7, which is used to force swirl the air and fuel within a centripetal vortex or vortices. In one preferred embodiment of this invention, air is directed to valve assembly 42 from a compressed air holding tank or forced air assembly that is connected to an air:fuel metering valve 310, such as shown in FIGS. 20, 21A and 21B.

The volume of air and/or fuel released from valve assembly 42 is controlled by sliding pintle 60 that enables the simultaneous opening or closing of air and/or fuel inlet openings 48, 52, as well as air and/or fuel outlet passages 50, 54. The volume may be further refined by scaling up or down the size of air inlet opening 48, inserting metering tubes in air and/or fuel inlet openings 48, 52, adjusting the size of the inlet piping, and/or scaling the internal cylinders or passageways. In addition, precise volumes may be achieved by using two-stage pintle 60, as shown in FIG. 3, rather than solid single-stage pintle 60, as shown in FIG. 2.

Figure 5:
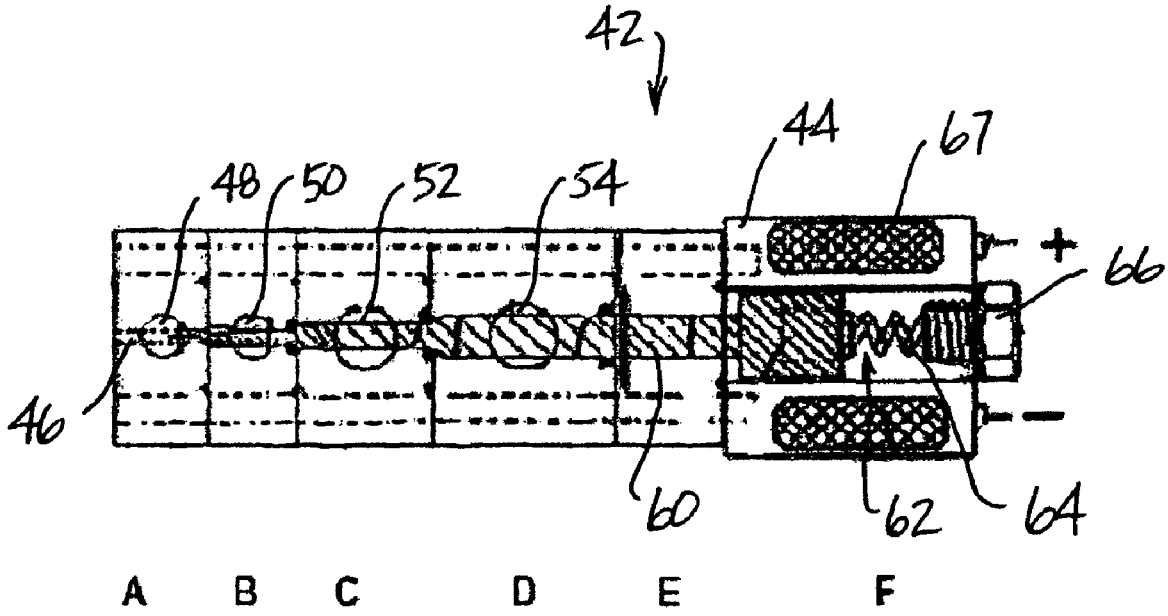
FIG. 5 is a partial sectional side view of an electrically operated valve assembly, according to one preferred embodiment of this invention.

In one preferred embodiment of this invention, valve assembly 42 is electrically operated. As shown in FIG. 5, valve assembly 42 has separate circular air and fluid discharge lines, namely air outlet passage 50 and fuel outlet passage 54, rather than angled air outlet passage 50 and fluid outlet passage 54, as shown in FIGS. 2 and 4A. In this embodiment, valve assembly 42 may be used in conjunction with the CID valve assembly, as shown in FIG. 7, to enable the delivery of a measured amount of air and fuel through valve assembly 42 into the CID valve assembly, wherein the air and fuel mixture is forced swirled.

Figure 4B:
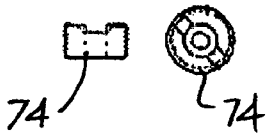
FIG. 4B is a front view of an air/fuel jet and seat, according to one preferred embodiment of this invention.
Figure 4C:
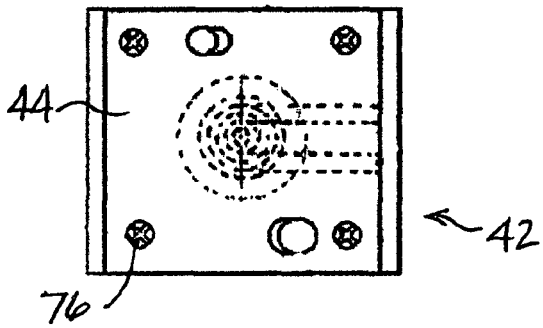
FIG. 4C is a front view of the valve assembly shown in FIG. 4A.
Figure 6:
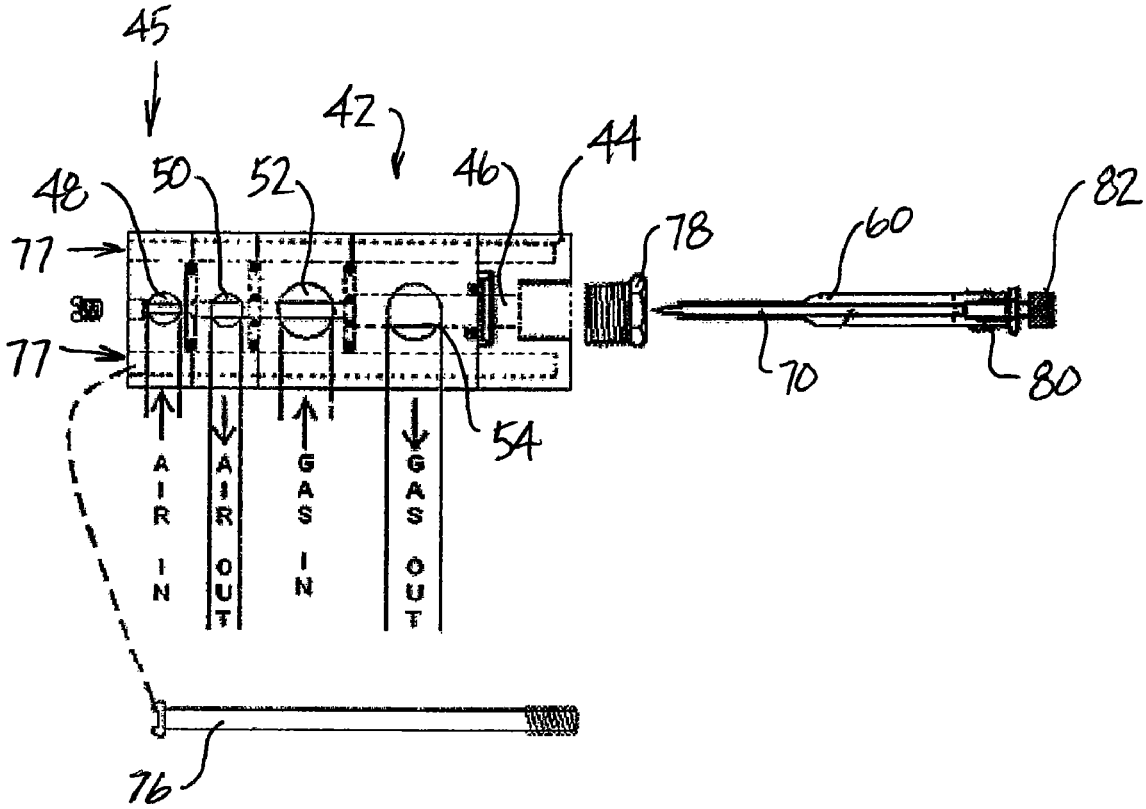
FIG. 6 is a side view of a manually operated valve assembly including a knob adjustor, according to one preferred embodiment of this invention.

In one preferred embodiment of this invention, valve assembly 42 includes air and/or fuel jets and seats 74, as shown in FIG. 2. When the air and/or fuel is ejected from valve assembly 42, the air and/or fuel jets 74 atomize the charge and create a spray pattern. A more detailed view of one preferred embodiment of jet and seat 74 is shown in FIG. 4B, and a front view of one preferred embodiment of valve assembly 42 is shown in FIG. 4C. A plurality of bolts 76, such as shown in FIGS. 4C and 6, extend through valve assembly 42 to internally connect and/or secure valve assembly 42. Additional bolt holes 77, as shown in FIG. 6, are used to secure the sides of valve assembly 42.

In one preferred embodiment of this invention, valve assembly 42 is manually activated and adjustable. The manually adjustability of valve assembly 42 enables the delivery of a precise amount of air and fluid to an individual unit, such as a fuel-fired stove. In one preferred embodiment of this invention as shown in FIG. 6, valve assembly 42 includes five modular blocks connected by various-sized o-rings. The tightness of the fit between the modular blocks is reinforced by using multiple bolts 76 and an end nut 78, as shown in FIG. 6.

In one preferred embodiment of this invention as shown in FIG. 6, the manually adjustable valve assembly 42 includes pintle 60 having threads 80 threadedly connectable to end nut 78 and/or block 44. An end knob 82 may be used to threadedly secure pintle 60 within bore 46. When end knob 82 is turned clockwise, pintle 60 moves toward block end portion 45 to form a seal and prevent air and/or fuel from entering and/or exiting valve assembly 42. In this embodiment, air enters valve assembly 42 through air inlet opening 48 in a first modular block and exits valve assembly through a separate air outlet passage 50 in a second modular block, while fuel enters valve assembly 42 through fuel inlet opening 52 in a third modular block and exits through fuel outlet passage 54 in a fourth modular block.

The volume or amount of air and fuel that passes through valve assembly 42 is controlled by turning end knob 82 counter-clockwise. In one preferred embodiment of this invention, manually activated valve assembly 42 includes pintle 60 having tapered portion 61. An upper or first portion of pintle 60 regulates the amount of air entering valve assembly, while a lower or second portion of pintle 60 regulates the amount of fuel entering valve assembly 42. Depending on the requirements of the system, manually operated valve assembly 42 may be equipped with a solid pintle 60 or a two-stage pintle 60 having adjustable needle 70, and may be used in conjunction with the CID valve assembly. In one preferred embodiment of this invention, each manually operated valve assembly 42 (with or without a CID valve assembly) is positioned at an opening of a single burner on a stove. When valve assembly 42 is actuated, a precise amount of air and fuel is then directed to the burner.

In one preferred embodiment of this invention, a valve assembly 142, referred to as a Centripetal Injection Device (CID) valve assembly, includes a block 144 forming or defining a mixing chamber 145. At least one air inlet opening 148 is formed in block 144 and extends into and communicates with mixing chamber 145. Preferably, valve assembly 142 includes two or more air inlet openings 148 each providing or directing pressurized, compressed or forced air into mixing chamber 145. In one preferred embodiment of this invention, valve assembly 142 has a general octagon shape and contains four openings, including two air inlet openings 148, one fuel inlet opening 152 and one outlet passage 155.

Figure 9:
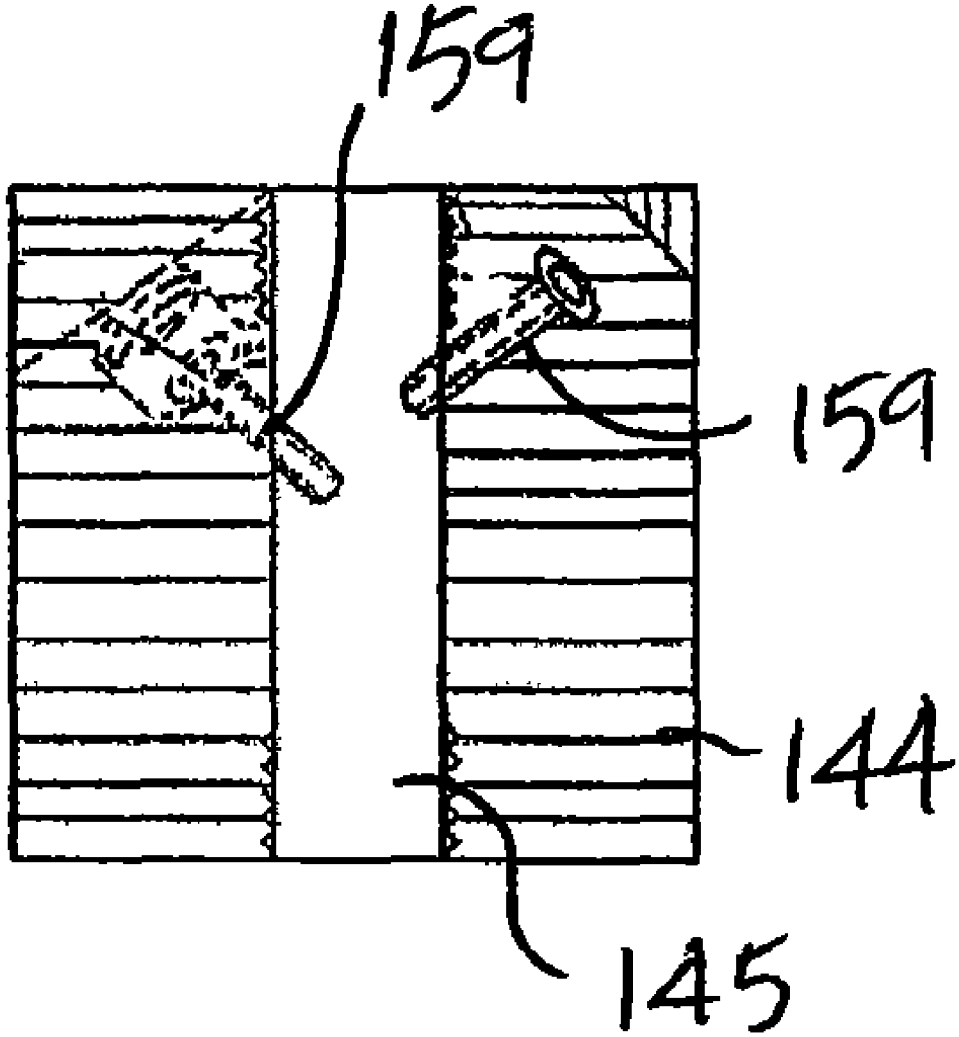
FIG. 9 is a front view of a valve assembly including air metering tubes, according to one preferred embodiment of this invention.

As shown in FIGS. 7-9, block 144 forms two opposing angled surfaces 157. Preferably, one air inlet opening 148 is formed in each angled surface 157 and extends into mixing chamber 145. Referring further to FIGS. 8A-8F, each air inlet opening 148 extends tangentially into mixing chamber 145 and tangential relative to each other.

An air inlet line 149 is positionable with respect to and connectable to each air inlet opening 148 to provide an amount or volume of air into mixing chamber 145. As shown in FIGS. 8A-8F, each air inlet opening 148 is formed or connected with mixing chamber 145 in a tangential relationship so that the pressurized air entering mixing chamber 145 through air inlet opening 148 creates an air flow path that includes at least one centripetal vortex. Preferably, an adjustable air metering tube 159 is positionable within each air inlet openings 148 as desired, as shown in FIG. 9. Air metering tube 159 forms an opening that may be sized or adjusted to control or regulate the flow and volume of the air directed into mixing chamber 145. As shown in FIG. 9, air metering tube 159 having a desirably sized opening may be installed in valve assembly 142 to meter the pressurized, compressed or forced air directed into mixing chamber 145. In one preferred embodiment of this invention, air metering tube 159 is interchangeable with a second air metering tube 159 having a larger or smaller opening to increase or decrease, respectively, the flow of air directed into the mixing chamber 145. An o-ring or other suitable gasket is preferably positioned about air metering tube 159 to sealingly position air metering tube 159 within air inlet opening 148.

In one preferred embodiment of this invention, air inlet lines 149 are connected to a main air feed 150 and branch from main air feed 150. Each air inlet line 149 is positionable within and connectable within to a corresponding air inlet opening 148 formed in block 144 using a suitable fitting or connector 151. Preferably, main air feed 150 is connected to a compressed air holding tank or other source of pressurized, compressed or forced air. In one preferred embodiment of this invention, an air:fuel metering valve 310, as shown in FIGS. 20, 21A and 21B, is connected between the compressed air holding tank or other source of pressurized, compressed or forced air and main air feed 150. Additionally, or alternatively, a Vortex V valve assembly, such as valve assembly 42, may be connected between the compressed air holding tank or other source of pressurized, compressed or forced air and main air feed 150. Compressed air holding tank may be operated or powered using any suitable source, such as electricity or solar energy and associated solar panels.

Fuel inlet opening 152 is formed in block 144 and in communication with mixing chamber 145. A fuel inlet line 153 is positionable with respect to and connectable to fuel inlet opening 152 to provide an amount or volume of fuel into mixing chamber 145. As shown in FIG. 7, at least one outlet passage 155 is in communication with mixing chamber 145. The fuel introduced through fuel inlet opening 152 mixes with the pressurized air introduced tangentially into mixing chamber 145 through air inlet openings 148 to produce an air:fuel mixture having a predetermined or precise air-to-fuel ratio. The air:fuel mixture exits mixing chamber 145 through outlet passage 155.

Figure 10:
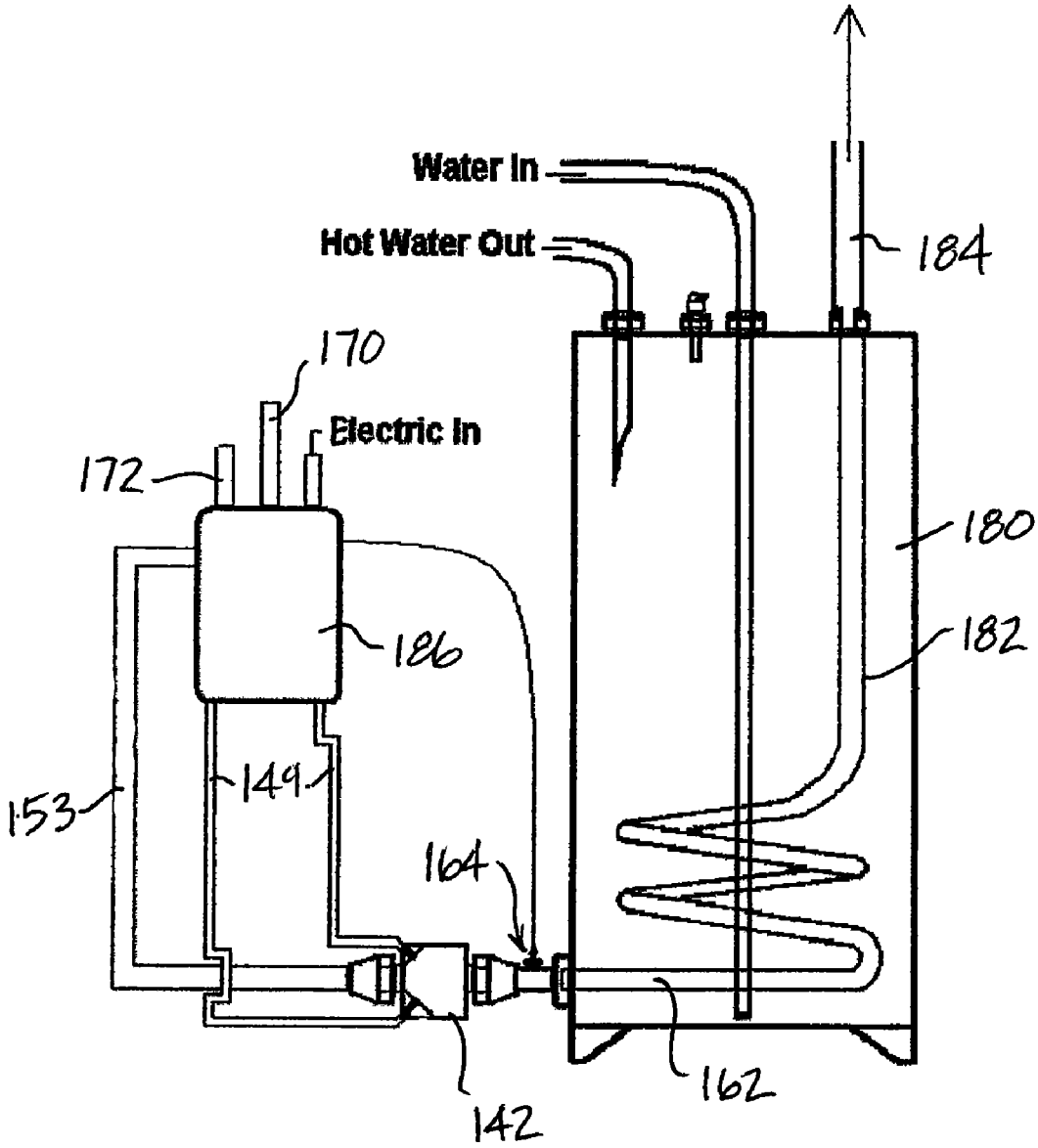
FIG. 10 shows an immersible burner assembly, according to one preferred embodiment of this invention.

In one preferred embodiment of this invention, the air:fuel mixture is then directed to a burner 162 or other suitable component connected at an output end portion of outlet passage 155. As shown in FIG. 10, an ignitor 164 operatively connected to burner 162 ignites the air:fuel mixture to produce a controlled flame and heat. While the burner shown in FIG. 10 shows one embodiment of this invention, other embodiments including a single burner or a plurality of burners may be installed on a unit, device or system including, but not limited to, a burner or stove.

Figure 14:
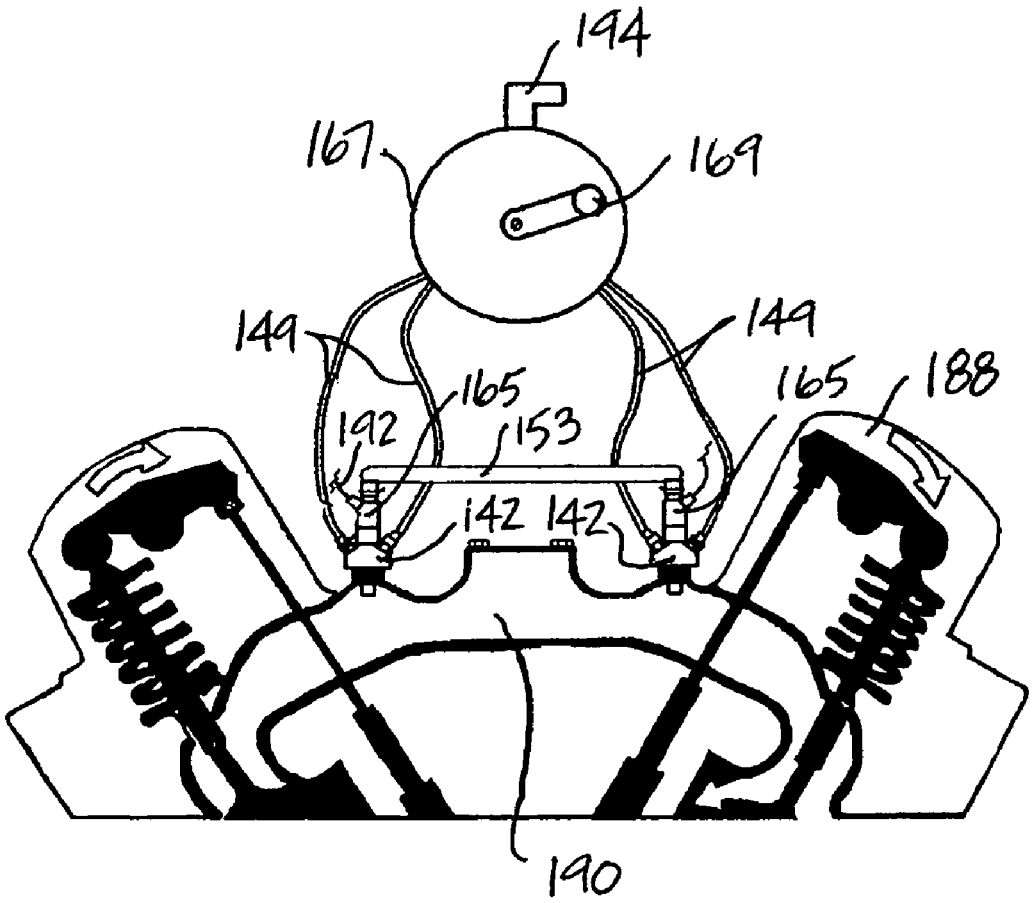
FIG. 14 is a perspective view of an air distribution system for a heat engine, according to one preferred embodiment of this invention.

In one preferred embodiment of this invention, valve assembly 142 includes a fuel injector device 165 positioned within fuel inlet opening 152 to provide communication between fuel inlet line 153 and mixing chamber 145, as shown in FIGS. 11-14. Preferably, an air control lever 167 is connected to each air inlet line 149, as shown in FIG. 14. The volume of air is discharged tangentially into mixing chamber 145 through air inlet openings 148. Within mixing chamber 145, the fuel entering the mixing chamber 145 through fuel injector device 165 mixes with the pressurized air entering mixing chamber 145 to form or provide the air:fuel mixture. The forced swirled air:fuel mixture then exits outlet passage 155 in a flow path having at least one centripetal vortex.

A desired amount or volume of fuel enters mixing chamber 145 through fuel inlet opening 152. Fuel inlet opening 152 provides communication between a fuel line (not shown) and valve assembly 142. In one preferred embodiment of this invention, each air inlet opening 148 varies symmetrically with an opposing air inlet opening 148 by approximately 10° and forms an opposing right angle. In one preferred embodiment of this invention, each angled air inlet opening 148 starting at a shoulder of valve assembly 142 has a different angle such that one air inlet opening 148 is positioned at approximately 42° and the other is positioned at approximately 50°. In this manner, one air inlet opening 148 is longer than the corresponding air inlet opening 148, while the point of intersection with mixing chamber 145 is perpendicular or formed at 90°. If more than two air inlet openings are formed in block 144, the angle of incidence, position, and length of the air inlet openings can be adjusted to enable the delivery of air to initiate a centripetal flow within mixing chamber 145.

Figure 11:
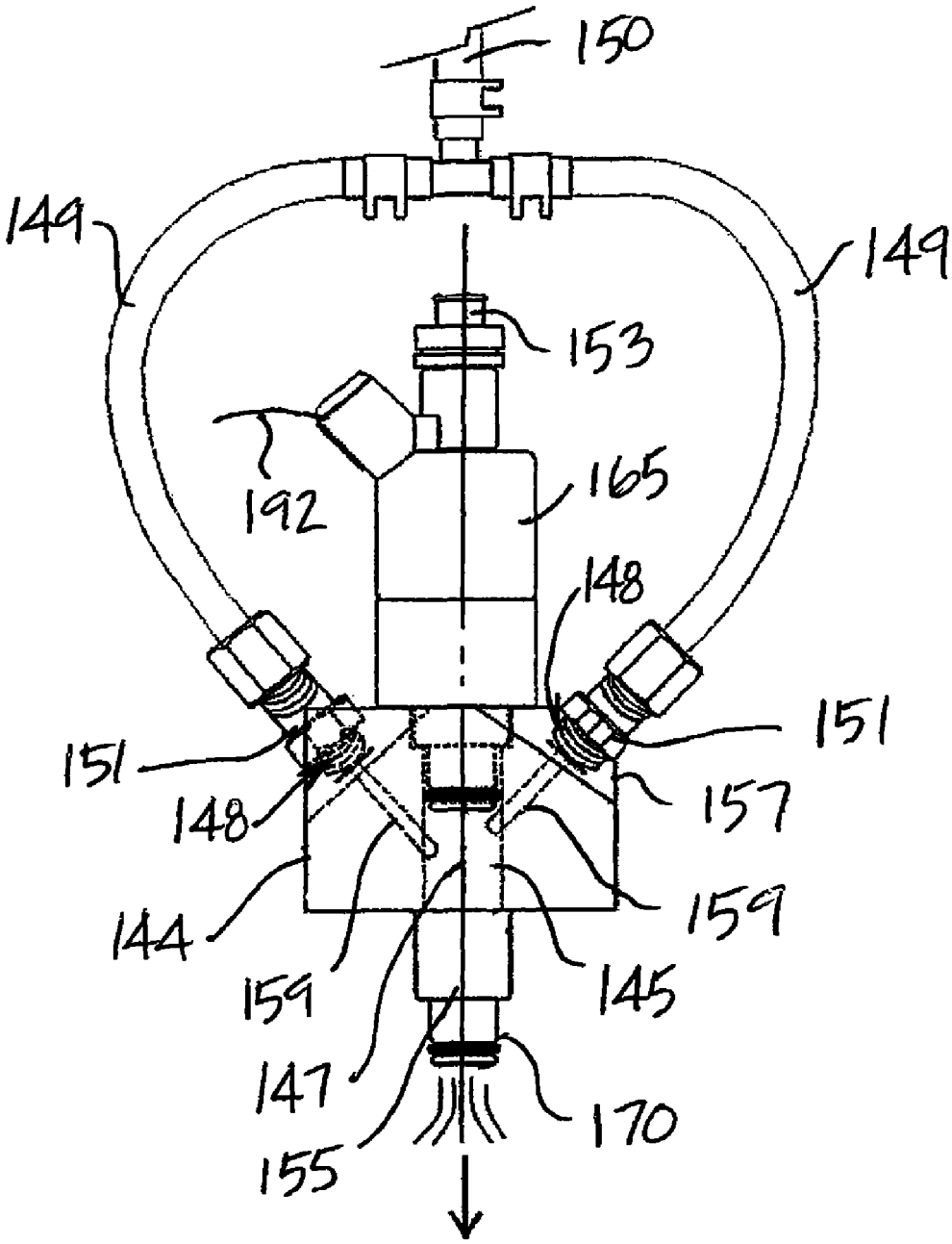
FIG. 11 shows a CID valve assembly connected to a fuel injector device, according to one preferred embodiment of this invention.
Figure 12A:
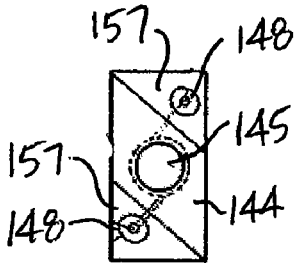
FIG. 12A is a top view of the CID valve assembly of FIG. 11.
Figure 12B:
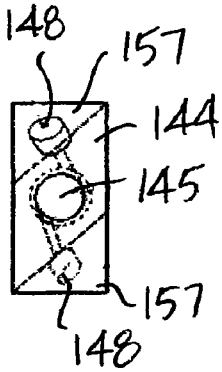
FIG. 12B is a bottom view of the CID valve assembly of FIG. 11.
Figure 12C:
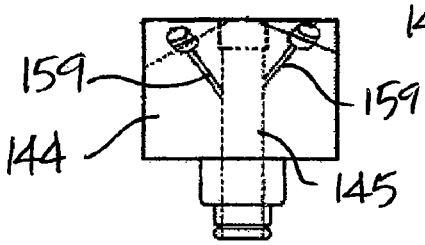
FIG. 12C is a front view of the CID valve assembly of FIG. 11.
Figure 12D:
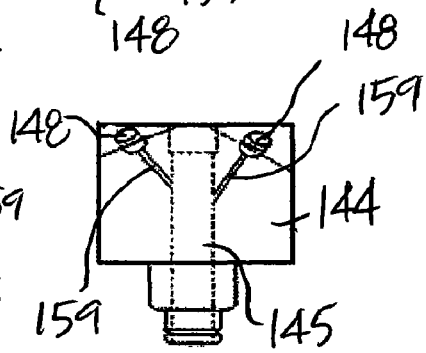
FIG. 12D is a back view of the CID valve assembly of FIG. 11.
Figure 13:
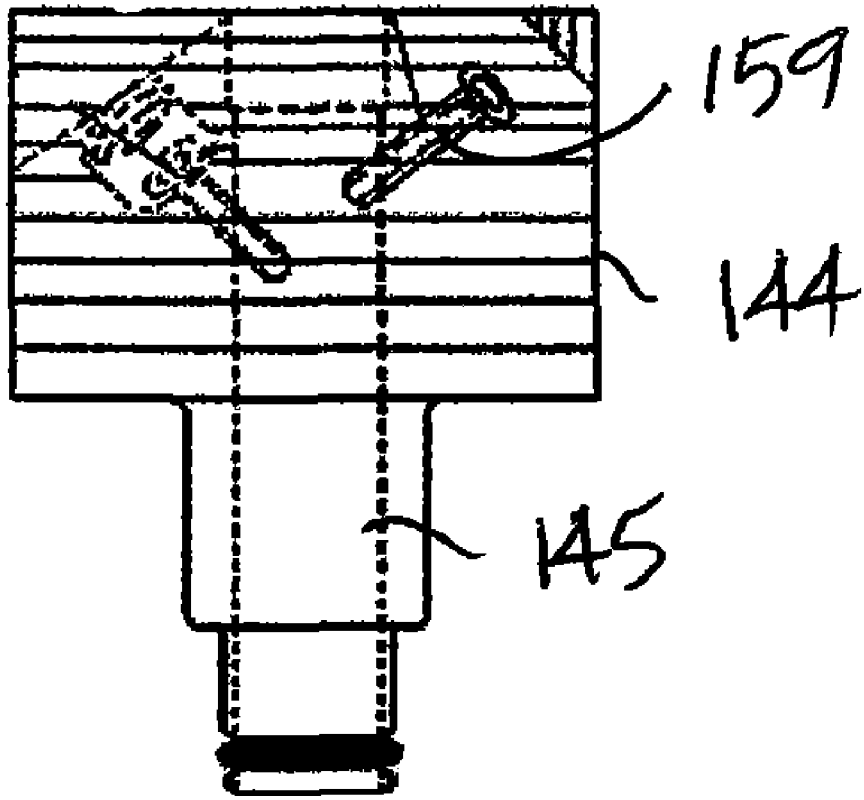
FIG. 13 is a front view of a valve assembly including air metering tubes, according to one preferred embodiment of this invention.

Preferably, angular air inlet openings 148 are positioned to enable the air to enter mixing chamber 145 within an angle of incidence that immediately directs the flow of air and fuel inward toward a central axis 147 of mixing chamber 145. As shown in FIG. 11, a base of block 144, includes or forms a discharge fitting or connector 170 that is attachable or connectable to a suitable component or device, such as an extension member, an extension/burner, or burner 162. It is apparent to those skilled in the art and guided by the teaching herein provided that each connection, fitting, and/or dimensions of the air and fuel lines, may be scaled upward or downward to meet the needs of individual units or systems. Additionally, multiple valves may be used in parallel to independently service a plurality of burners 162. While FIG. 7 shows a manually operated valve assembly 142, valve assembly 142 may also be configured to function automatically by substituting a solenoid for fitting 151 shown in FIG. 7.

In one preferred embodiment of this invention, an extension 160 is connected within outlet passage 155, as shown in FIG. 7. Depending on unit or system requirements, extension 160 may have any suitable shape and/or configuration. For example, extension 160 may be straight, curved, spiraled, or otherwise shaped. In one preferred embodiment of this invention, extension 160 contains a flared'end or a lip to provide increased or optimal flow of the burning air:fuel mixture. Preferably, combustion of the air:fuel mixture is initiated in extension 160 in one or more vortices. Extension 160 may connect burner 162 to valve assembly 142 or alternatively, burner 162 may be directly connected to outlet passage 155 of valve assembly 142.

In one preferred embodiment of this invention, to enable the creation and flow of flame within different configurations of vortices, extension 160 or burner 162 may be equipped with a flare or diffuser 175 that is square, circular, oblong, rectangular, or otherwise shaped, as shown for example in FIGS. 22A-22F. Depending on the requirements of the unit or system, diffuser 175 may also be crimped, contain ribbing that spirals inward or outward, or contain slotted openings that enable the creation of centripetal vortices, either separately or as a braided helix.

Figure 22A:
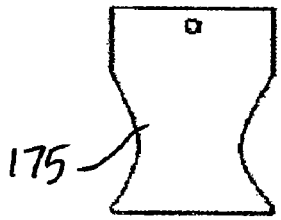
FIGS. 22A-22C are side views of extensions for different flame configurations, according to one preferred embodiment of this invention.
Figure 22B:
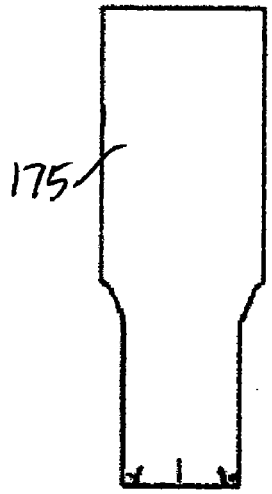
Figure 22C:
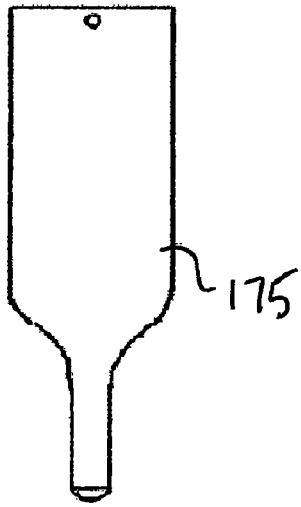
Figure 22D:
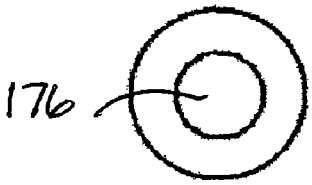
FIGS. 22D-22F are front views of the extensions of FIGS. 22A-22C, respectively.
Figure 22E:
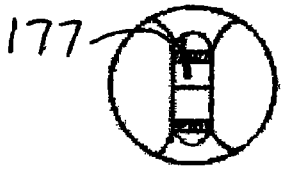
Figure 22F:
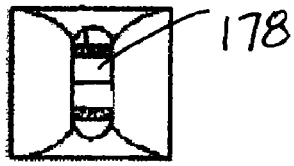
Figure 23A:
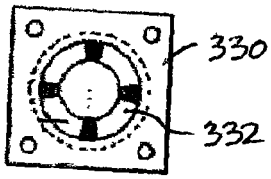
FIGS. 23A-23D show optional extension connections and configurations, according to one preferred embodiment of this invention.
Figure 23B:
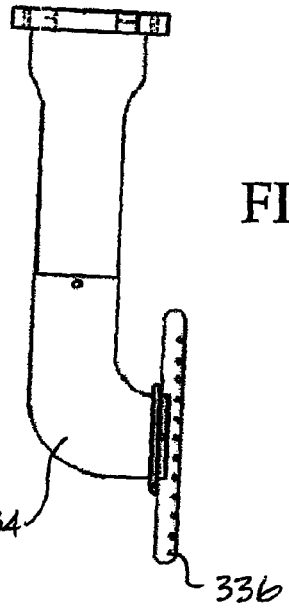
Figure 23C:
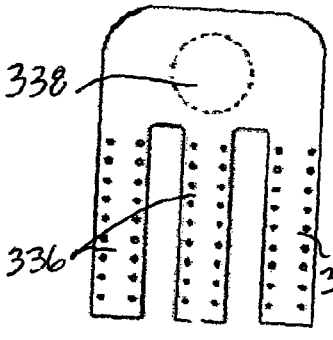
Figure 23D:
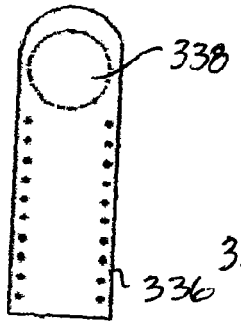

A circular orifice 176 shown in FIG. 22D and an elliptical orifice 177 shown in FIG. 22E may be used with either the short-stack extension 175 shown in FIG. 22A or the extended round tubing extension 175 shown in FIG. 22B. The rectangular tubing extension 175 shown in FIG. 22C may be used with the rectangular orifice 178 shown in FIG. 22F. In each instance, the orifice that covers extension 175 may determine the geometric configuration of the flame, the radial density, stratification, and mixture of the air:fuel mixture and/or the resulting angle of incidence of the generated flame.

The resulting flame configuration may be in the form of a blue triangle with multiple additional triangles around its base, a flat rectangular flame that may be created in a checkerboard pattern, a conical flame, or a more loosely controlled form. Alternatively, the configuration of the flame may be patterned in one or more vortices that exist as a vortex-within-a-vortex or other configuration that exhibits an axis-symmetric laminar flow.

Additionally, to meet the requirements of an individual unit, system, or process, extension 160 may be connected to piping that contains proportion vanes and then to a multi-stage or standard burner, directly to a burner, or function as both an extension and burner. Because the combustion process is initiated in the extension/burner in one preferred embodiment of this invention, extension 160 itself may function as a single burner or multiple burners that consist of multiple extensions/burners connected to one or more valve assemblies 142. In one preferred embodiment that utilizes multiple extensions/burners, the extensions/burners may operate in parallel, or individual burners may be adjusted to create cooler or warmer zones of heat. Alternatively, extension 160 may function as an extension whose primary purpose is to mix the air and fuel within one or more vortices prior to discharging the air:fuel mixture into a unit or system for further processing.

In one preferred embodiment of this invention as shown in FIG. 10, burner 162 extends directly from valve assembly 142 into a heating unit 180, such as a hot water heater, through immersible burner 182. Immersible burner 182 preferably increases the residence time of the flame front and enables the exhaust gases to cool before being discharged into a flue and/or chimney 184 connected to heating unit 180.

As shown in FIG. 10, air and fuel enter a control box 186 through air inlet line 170 and fuel inlet line 172, respectively. The metered gas (fuel) is discharged from control box 186 and enters valve assembly 142 through gas inlet line 153. Air enters valve assembly 142 through air inlet lines 149, and valve assembly 142 discharges the air:fuel mixture into burner 162 within a centripetal vortex or vortices. Igniter 164 ignites the air:fuel mixture, and the flame front advances through burner 162 within heating unit 180. Depending on the requirements of the unit or system, the end of immersible burner 182 may contain a flare or nozzle assembly to enable the further configuration of the formation of the vortex or vortices within burner 162. To maintain the pattern of the flow, the windings of burner 162 may be circular and then straight or spiraled upward within an inverted helix.

In one preferred embodiment of this invention, burner 162 winds around the inside or the outside of heating unit 180 rather than being immersed in water. While FIG. 10 shows valve assembly 142 connected to a hot water tank, valve assembly 42 may be connected to boilers, stoves and/or other units and systems as would be apparent to those skilled in the art and guided by the teachings herein provided.

In one preferred embodiment of this invention as shown in FIG. 11, valve assembly 142 including fuel injector device 165 regulates the amount of air and fuel delivered to an engine 188. In this preferred embodiment, forced or compressed air is directed through main air feed 150 and into separate or divided air inlet lines 149 that are connected to block 144. Connectors 151 are connected to metering tubes 159 to deliver the forced or compressed air charge into mixing chamber 145 tangentially and thereby create a forced swirling effect including a centripetal vortex or vortices. Air metering tubes 159 may be scaled up or down to meet the requirements of different sized engines.

O-rings or other suitable gasket or sealing components are preferably used to seal and prevent the escape of the air and/or fuel pressures along with the engine pressures. The forced swirled air:fuel mixture is discharged from CID valve assembly 142 through outlet passage 155, allowing the air:fuel mixture to feed directly into an engine intake manifold 190, as shown in FIG. 14. Fuel enters valve assembly 142 through fuel inlet opening 152 that preferably extends along a central axis of valve assembly 142. Preferably, fuel inlet opening 152 may be attached or connected to the original fuel rails of engine 188. Depending on the requirements of the system, the fuel rail assembly may have to be repositioned so that valve assembly 142 may be installed between fuel injector device 165 and engine manifold 190, as shown in FIG. 14. Valve assembly 142 may be activated or deactivated by using a standard electrical connection 192 used by the engine manufacturers.

As shown in FIG. 14, an auxiliary air intake 194 connected to the pressurized, compressed or forced air assembly may be regulated by an air control lever 167 connected to function in tandem with a gas pedal linkage 169. Gas inlet line 153 is connected to fuel injector devices 165 and air inlet lines 149 are connected to valve assembly 142. Upon mixing of the air and fuel within mixing chamber 145, the discharged air:fuel mixture exhibits a high degree of atomization and mixedness. In addition, the discharged air:fuel mixture is directed into engine manifold 190 in a single vortex or multiple centripetal vortices.

In one preferred embodiment of this invention as shown in FIGS. 15-19B, a valve assembly 242, referred to as a multi-stage valve assembly, includes a block 244 that forms or defines a mixing chamber 245. An air inlet opening 248 is formed in block 244 and communicates with mixing chamber 245. An air inlet line 249 is positionable with respect to and connectable to air inlet opening 248 and provides or directs a volume of air into mixing chamber 245. Preferably, air inlet opening 248 provides or directs pressurized, compressed or forced air into mixing chamber 245. A fuel inlet opening 252 is formed in block 244 and communicates with mixing chamber 245. A fuel inlet line 253 is positionable with respect to and connectable to fuel inlet opening 252 and provides or directs a volume of fuel into mixing chamber 245.

Figure 19A:
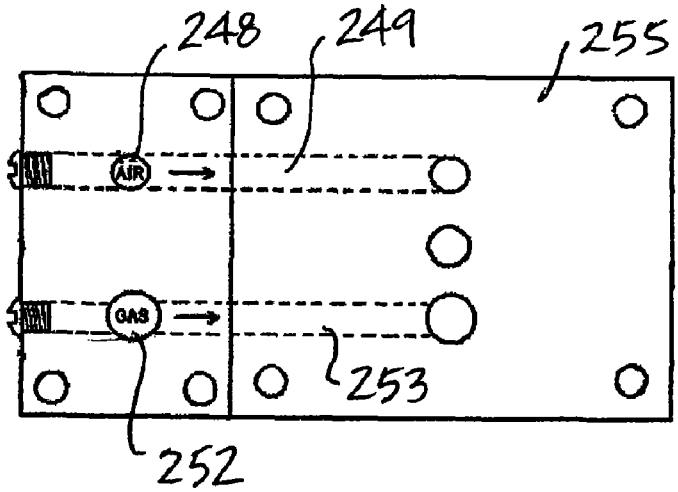
FIG. 19A is a front view of a base plate of a multi-stage valve assembly, according to one preferred embodiment of this invention.
Figure 19B:
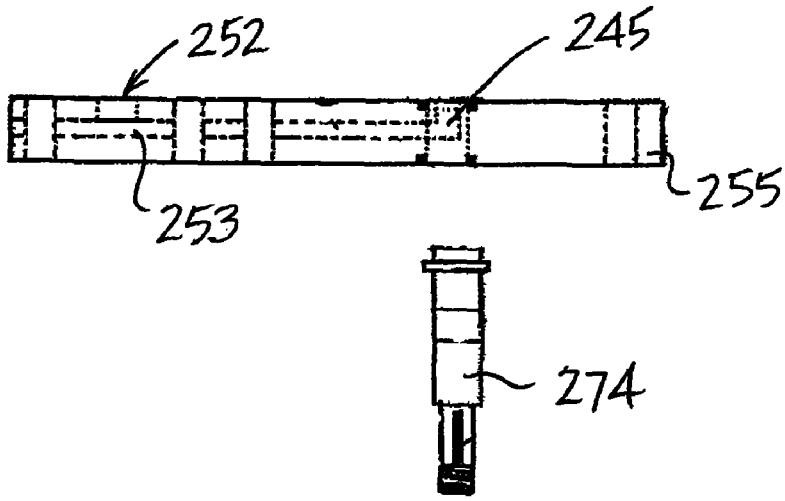
FIG. 19B is a side view of the base plate of FIG. 19A and adjustment post.

A base plate 255 of valve assembly 242 preferably forms or includes at least a portion of air inlet line 249 extending from and communicating with air inlet opening 248 and/or at least a portion of fuel inlet line 253 extending from and communicating with fuel inlet opening 252, as shown in FIG. 19A. Referring to FIG. 19B, in one preferred embodiment of this invention, air inlet line 249 and fuel inlet line 253 communicate at mixing chamber 245.

Figure 15:
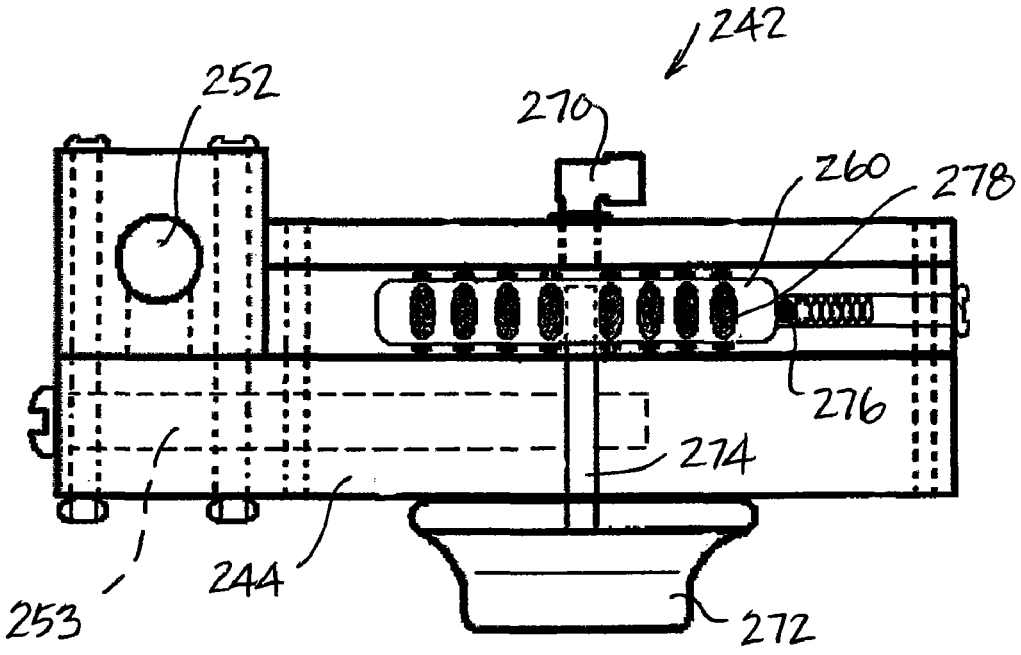
FIG. 15 is a top view of a valve assembly, according to one preferred embodiment of this invention.
Figure 16:
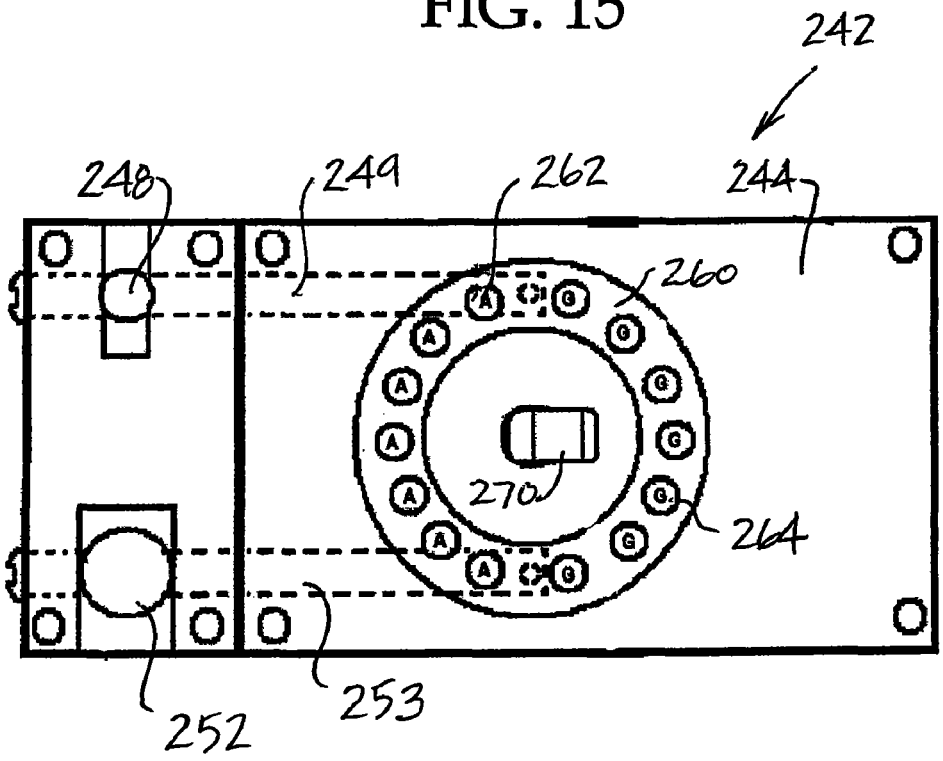
FIG. 16 is a side view of the valve assembly of FIG. 15.
Figure 17:
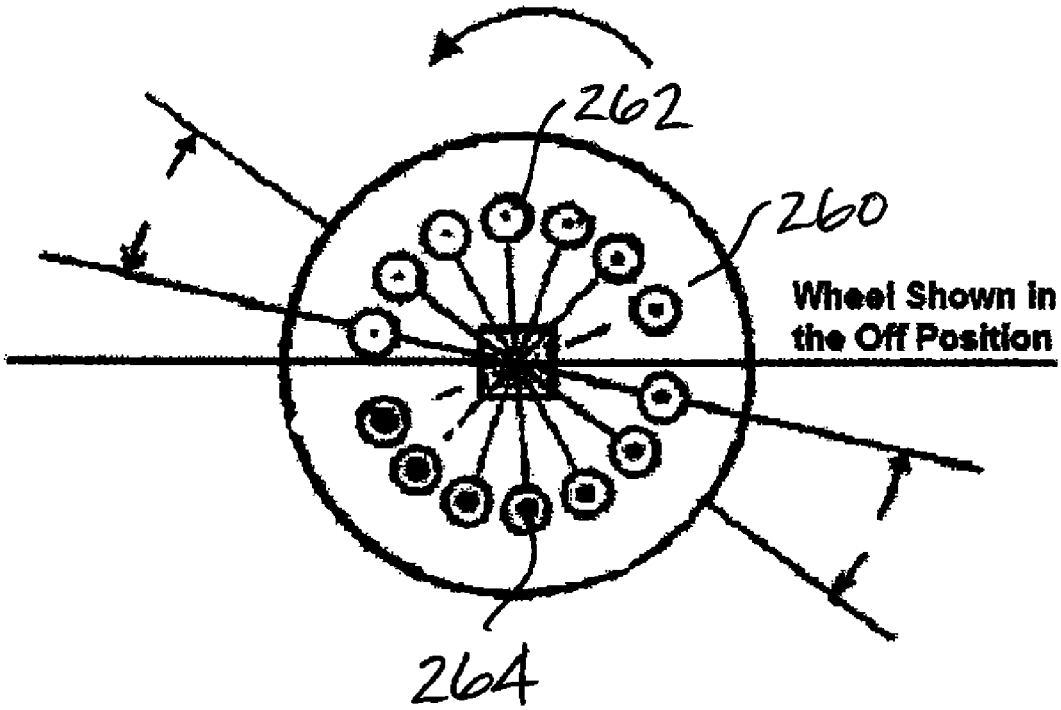
FIG. 17 is front view of a multi-stage adjustable dial plate, according to one preferred embodiment of this invention.

As shown in FIGS. 15-17, a rotatable metering wheel 260 forms a plurality of air passages 262. Each air passage 262 preferably has a different opening area than other air passages 262. Similarly, metering wheel 260 also forms a plurality of fuel passages 264. Each fuel passage 264 has a different opening area than the other fuel passages 264. In one preferred embodiment of this invention, each air passage 262 cooperates or is associated with a corresponding fuel passage 264, as shown in FIGS. 16 and 17, to allow a desired or measured volume of air and a corresponding volume of fuel, respectively, into mixing chamber 245. Metering wheel 260 is selectively rotatable to align one air passage 262 with air inlet line 249 to provide communication between air inlet opening 248 and air passage 262, and to align one preferably corresponding fuel passage 264 with fuel inlet line 253 to provide communication between fuel inlet opening 252 and fuel passage 264. Metering wheel 260 controls or regulates the amount or volume of air entering mixing chamber 245 and the amount or volume of fuel entering mixing chamber 245.

In one preferred embodiment of this invention, an outlet passage 270 communicates with mixing chamber 245. Upon mixing of the air and fuel within mixing chamber 245, an air:fuel mixture exits mixing chamber 245 through, outlet passage 270, as shown in FIGS. 15 and 16. Preferably, valve assembly 242 includes a selector knob 272 operatively connected to metering wheel 260 to selectively align one air passage 262 with air inlet line 249 and one fuel passage 264 with fuel inlet line 253. For example, in one preferred embodiment of this invention an adjustment post 274 connects selector knob 272 to metering wheel 260.

In an alternate preferred embodiment of this invention, valve assembly 242 may include an independent air outlet passage 270 in communication with air inlet line 249 and an independent fuel outlet passage 270 in communication with fuel inlet line 253 to prevent mixing of the air and fuel within valve assembly 242.

Figure 18A:
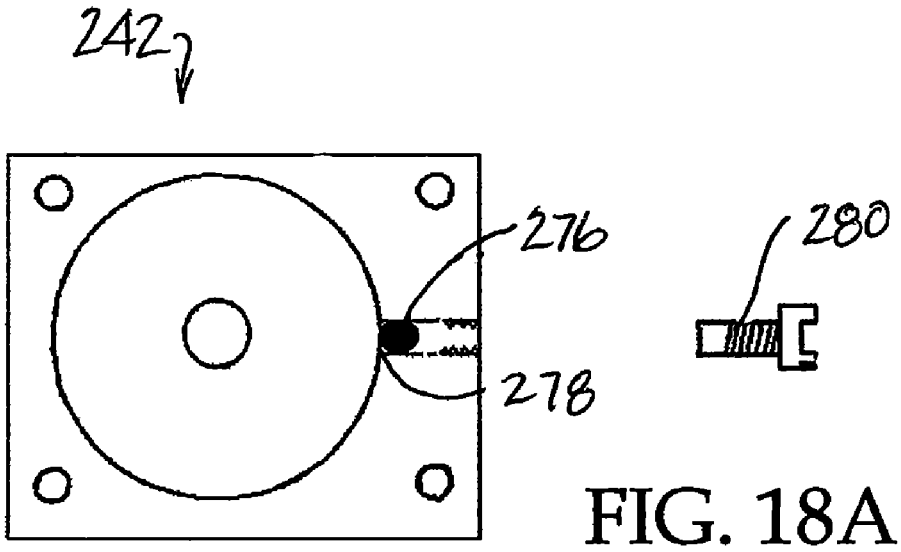
FIG. 18A is a top view of a multi-stage valve assembly top plate, according to one preferred embodiment of this invention.
Figure 18B:
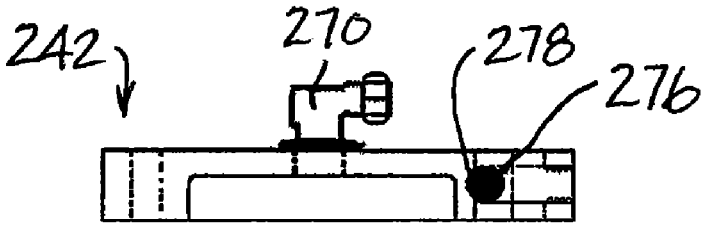
FIG. 18B is a side view of the top plate of FIG. 18A.
Figure 18C:
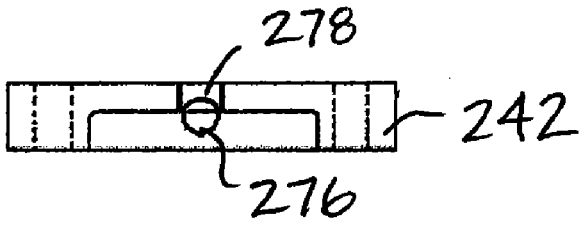
FIG. 18C is a side view of the top plate of FIG. 18A.

As shown in FIGS. 15 and 16, in one preferred embodiment of this invention, a detent ball 276 cooperates with or interferes with a notch 278 formed on metering wheel 260 allowing valve assembly 242 to regulate the amount of fluid and pressurized air passing through valve assembly 242. As shown in FIG. 15, metering wheel 260 includes or forms a plurality of notches 278 or indentations preferably evenly spaced around a periphery of metering wheel 260. Metering wheel 260 is rotatable to selectively allow detent ball 276 to interfere with a selected notch 278 corresponding to air passage 262 and fuel passage 264 to provide a desired amount or volume of air and fuel to pass through valve assembly 242. Rotation of metering wheel 260 aligns air passage 242 with associated or corresponding gas passage 264 to permit the optimal air:fuel mixture to be distributed. As shown in FIGS. 18A, 18B and 18C, detent ball 276 may be urged against associated or selected notch 278 using a locking screw 280 or other suitable biasing component.

In one preferred embodiment of this invention, valve assembly 242 is connectable to a furnace or other suitable apparatus to regulate the heating output of the furnace. Each selected or staged setting permits the generation of a different heating capacity by allowing the air and fuel to flow through selected air passages 262 and fuel passages 264, respectively. The degree of spacing of adjacent air passages 262 and fuel passages 264 as well as the diameter of the passages may depend on the requirements of the unit. In one preferred embodiment of this invention, the air and fluid may exit valve assembly 242 through one outlet passage 270, or through a separate or independent air outlet passage and a separate or independent fuel outlet passage. If the preset amount of air and fluid is directed out of separate outlets, an additional valve assembly, such as valve assembly 42 or valve assembly 142, and/or an extension may be used to enhance the atomization and mixture of the air and fluid. If the air and fluid exit outlet passage 270, outlet passage 270 may be directed into an extension that is connected to a heating unit, for example.

As shown in FIG. 16, in one preferred embodiment of this invention, air passages 262 and fuel passages 264 settings are preset on metering wheel 260 prior to using the unit. Pressurized air enters valve assembly 242 through air inlet opening 248 while fuel enters valve assembly 242 through gas inlet opening 252. When a connected gas burner or unit is activated, the air:fuel mixture having an exact or optimal air:fuel ratio passes through valve assembly 242 and exits through outlet passage 270.

In one preferred embodiment of this invention, distribution system 40 includes a fuel and air mixing valve 300 that functions by opening a safety shut-off valve to direct low-pressure compressed air from an air tank and fuel from a fuel tank into the fuel and air mixing valve 300 that is connected to a unit. As shown in FIG. 20, with valve 300 opened, the fuel, such as propane, can flow from a typical propane canister (not shown) through fuel line 302 and low-pressure air from an air tank (not shown) can be directed into fuel and air mixing valve 300 through air line 304. Valve 300 regulates the amount of air and fuel distributed through valve 300 into a unit, such as a grill burner. The measured amounts of fuel and air are then released into a pipe or tube extension where the mixture is directed into and distributed through the grill burner.

In one preferred embodiment of this invention, a fuel and air metering valve 310, as shown in FIGS. 21A and 21B contains a single forced air or compressed air inlet 312, a pressurized air control valve and knob 314, a fuel temperature control valve and knob 316, and a fuel line inlet 318. Depending on the requirements of the individual unit or system, the air and fuel may be directed to a single outlet 320, as shown in FIG. 21B, or managed separately and directed into separate air outlet 322 and fuel outlet 324, as shown in FIG. 21A.

As shown in FIGS. 21A and 21B, air and fuel enter valve 310 from separate inlets 312, 318, and the amount of fuel and air may be adjusted manually by turning the knob 316 to regulate the volume of incoming fuel and knob 314 to regulate the volume of incoming air. Metering valve 310 may be used in conjunction with a Vortex-T valve assembly 42, a CID valve assembly 142, or a multi-stage valve assembly 242 to regulate the volume of air and/or fuel directed into the associated valve assembly.

As shown in FIG. 22A, extension 175 may include an extension plate 330 having an interior swirl plate assembly 332. As shown in FIG. 22B, extension 175 may be further expanded by a second curved tube 334 and then connected to an individual burner 336. Depending on the requirements of the unit, an inlet air orifice 338, as shown in FIGS. 22C and 22D, may provide or allow communication between extension 175 and a plurality of burners, as shown in FIG. 22C, or a single set of burners, as shown in FIG. 22D. Any suitable burner arrangement may be used with extension 175. The type and shape of the tubing or piping used for extension 175 depends on the requirements of the system and may include one tube or pipe or multiple tubes or pipes.

Figure 24A:
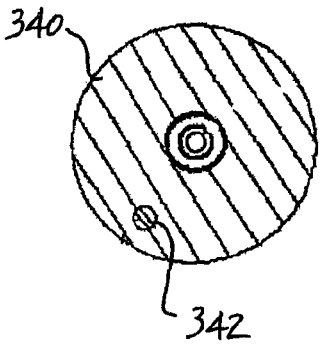
FIG. 24A is a front view of an air adjusting plate, according to one preferred embodiment of this invention.
Figure 24B:
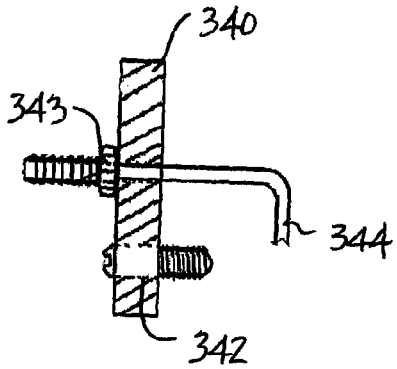
FIG. 24B is a side view of the air adjusting plate of FIG. 24A.

In one preferred embodiment of this invention, an air adjusting sliding plate 340 shown in FIGS. 24A and 24B may be used with a heating unit to prevent a flash back of the charge. As shown in FIG. 24B, plate 340 includes or forms an opening 342 in which a screw or other suitable fastener can be positioned to attach an air injection hose type fitting 343 including an air deflector tube 344 or any suitable hose fitting that would permit the influx of air into the unit. Depending on the requirements of the system, the hole drilled into the plate may contain a lip or curved and/or ribbed protrusion that would enable the greater mixture of the charge delivered to the inlet within a centripetal vortex.

Figure 25A:
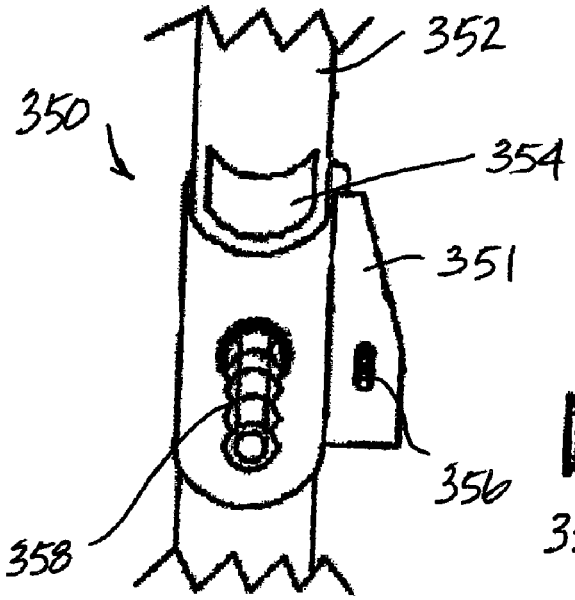
FIG. 25A is a perspective front view of an air adjusting sleeve, according to one preferred embodiment of this invention.
Figure 25B:
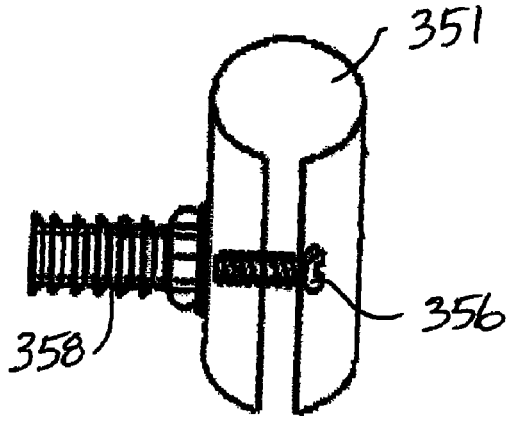
FIG. 25B is a perspective side view of the air adjusting sleeve of FIG. 25A.

In one preferred embodiment of this invention, distribution system 40 may include an air adjusting sleeve assembly 350, as shown in FIGS. 25A and 25B. Air adjusting sleeve assembly 350 includes an adjustable sleeve 351 that is slidably or movably positioned about a pipe 352 having or forming a cut-out air inlet 354 and securely fastenable to pipe 352 using a suitable fastener or connector, such as screw 356. The amount of air permitted to flow into air inlet 354 is adjustable by moving sleeve 351 along a length of pipe 352 and is dependent on ambient conditions. As shown in FIG. 25A, sleeve 351 forms a nipple or projection 358 that permits the attachment of an air hose, tube, or pipe. Sleeve 351 is slidably movable with respect to pipe 352 and air inlet 354 to at least partially cover air inlet 354. The distribution system may be installed as an aftermarket product.

Figure 26A:
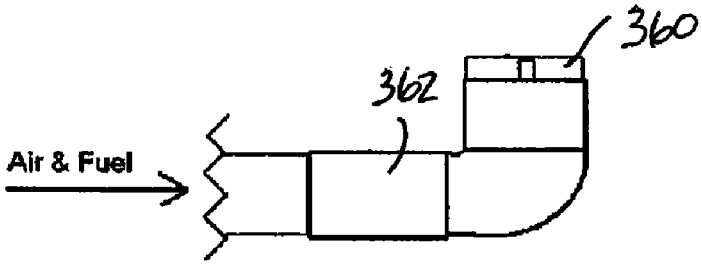
FIGS. 26A-26C show air proportion vanes used to direct an air:fuel mixture, according to one preferred embodiment of this invention.
Figure 26B:
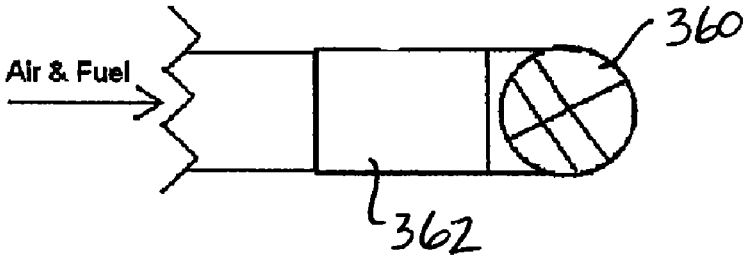
Figure 26C:
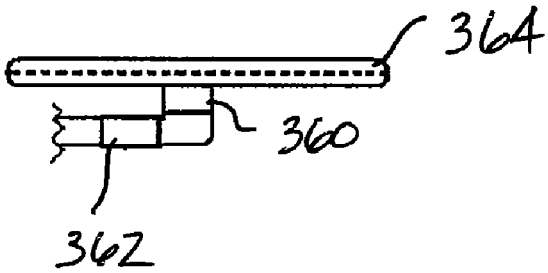

In one preferred embodiment of this invention, outlet passage for valve 42, 142 or 242 may be connected to an extension, extension/burner, or piping, generally shown in FIGS. 26A and 26B as extension 362 that contains bends that would inhibit the flow or advancement of the air and/or fuel. As shown in FIGS. 26A and 26B, air proportion vanes 360 distribute the air:fuel mixture or combusting air:fuel mixture in a more proportionate or even manner throughout a burner or other processing unit or system. Depending on the requirements of a particular unit or system, vanes 360 may consist of a vane with a curve beginning at the base of the curve and extending only slightly along a length of the pipe from the base and a second vane with a curve beginning at the base and then extending along a length of the pipe preferably approximately ¼ the length of the pipe. Alternatively, the curved pipe contains ribbing or vanes that extend from the base of the pipe to the top of the pipe in an equivocal or Fibonacci sequence. Preferably, an angle of the spiral or vane will be positioned at the bend or curve of the piping to enhance the flow when the particular unit, system, or assembly requires piping with one or more bends. As shown in FIG. 26C, a burner 364 can be attached or connected to extension 362 at or near vanes 360.

FIG. 26A shows an extension 362 and a curved connecting pipe that contains or includes vanes 360. FIG. 26B shows a top view of vanes 360 included in the curved pipe. Preferably, vanes 360 are offset from a center line defined by the pipe to enable the distribution of fuel in a more even manner and thereby generate a more even burn. FIG. 26C shows a complete assembly of extension 362 with the curved pipe attached to burner plate 364.

In one preferred embodiment of this invention, the system includes a self-locking hose connector 370, as shown in FIGS. 27A-27C. Hose connector 370 is fastenable or otherwise connectable between two pipes, hoses, tubes, and/or any other appurtenances without the use of a threaded male/female fastener and/or other type of exterior clamp. In one preferred embodiment, hose connector 370 is connectable to a housing 372 which may contain a notch 373 or lip, an o-ring 374, a hose barb 375, and an internal retaining spring clip 376 or round self-locking clip 377. O-ring 374 is attached to the hose barb 375, which is securely seated within housing 372 and then held in place by a self-locking internal spring clip 376 that fits within notch 373 of housing 372. Alternatively, hose barb 375 is seated within housing 372 and then held in place by a self-locking internal spring clip 376 that fits within the lip of housing 372. The assembled hose connector 370 is shown in FIG. 30C with an arrow indicating the flow of air. Locking hose connector 370 may include any other suitable components or parts know to those skilled in the art.

Figure 28A:
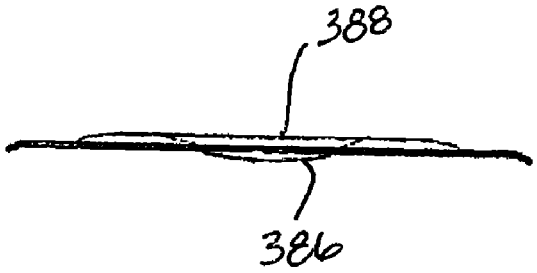
FIGS. 28A and 28B show a multi-stage burner plate assembly, according to one preferred embodiment of this invention.
Figure 28B:
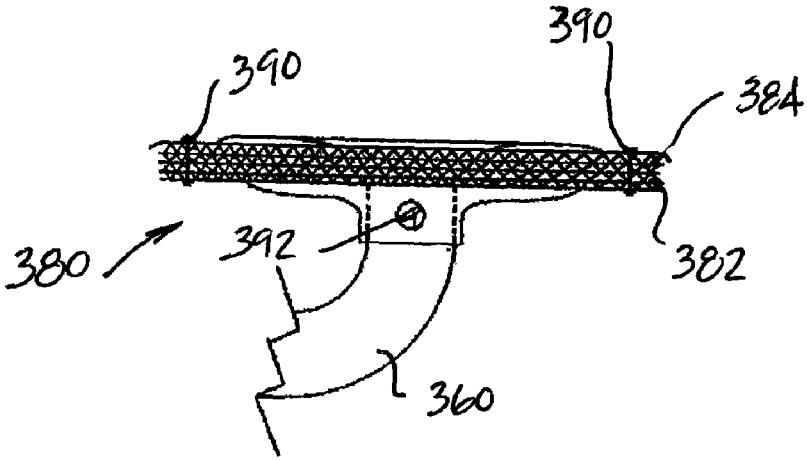
Figure 29:
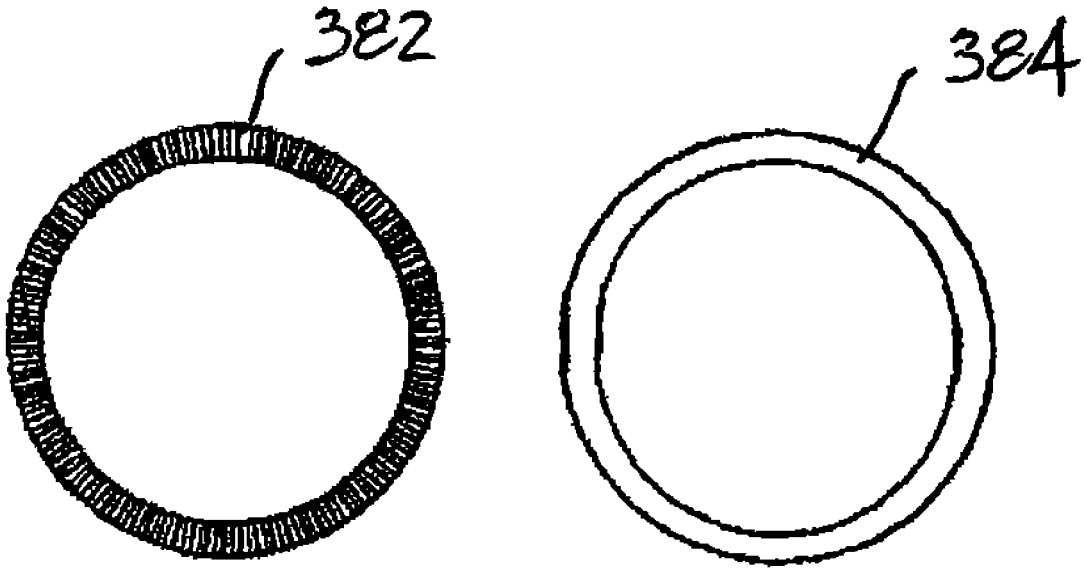
FIG. 29 shows a ribbed multi-stage burner plate and a flat multi-stage burner plate, according to one preferred embodiment of this invention.

In one preferred embodiment of this invention, distribution system 40 includes a burner assembly 380, as shown in FIGS. 28A, 28B and 29. Burner assembly 380 preferably includes individual, stacked, ridged plates 382 that are separated by flat plates 384 and form or contain a cylindrical opening in a center of the plate, as shown in FIG. 29. The opening enables the flames emitted from the extension/burner to flow up the center of burner assembly 380, and a top concave base 386 of a top cover plate 388 forces these flames to disperse out and penetrate through the ridged openings.

At an edge of burner, a downward angle directs the burnt gases downward to further reduce the NOx emissions formed by the combustion process. To meet the requirements of individual units or systems, the size and number of plates may be increased or decreased, accordingly. In one embodiment, burner assembly 380 is downstream of an extension in which combustion is initiated within one or more vortices. As the flame front moves through the extension and around air proportion vanes, some of the laminar steady flow dissipates into a recirculation flow that may extend to the left and right of the tube within the center of the multi-purpose burner. Because of the close relationship between the geometry of the recirculation zones and the heat transfer rate, the expanded swirling that extends into the various layers of the burner both enables a lower flame temperature and a longer residence rate as the flow dissipates into more turbulent recirculation zones. The recirculation zone geometric parameters may be largely dependent on the Reynolds number while the amount of heat transfer may correlate to the Prandtl number. Because the CID valve assembly is designed to increase the mixedness and atomization of the air:fuel mixture by weight, the resulting swirled mixture has a low Prandtl number and therefore a high convection capacity.

As shown in FIG. 28A, top cover plate 388 has concave base 386 that fills the center of the plate and rises to the edge of the plate. Top cover plate 388 fits over a supporting ridge that angles downward as a means of directing the burnt gases downward toward the burner. In one embodiment of the multi-stage burner, the ribbed plates 382 may be constructed of porous material to enhance the natural convection between the stacked plates. As shown in FIG. 28B, burner assembly 380 preferably includes a ridged plate 382 and a plurality of flat plates 384, such as three flat plates 384 nested between ridged plates 382. Flat plates 384 support ridged plates 382 and enable the flames to disperse more rapidly and evenly throughout burner assembly 380. Ridged plates 382 and flat plates 384 are connected by rivets, cotter pins, or another suitable connector 390 to provide support and maintain the alignment of burner assembly 380. Burner assembly 380 may be connected to a proportion vane 360, as shown in FIG. 28B, or an extension using a suitable fastener, such as a screw 392.

As shown in FIGS. 30A-30C, distribution system 40 may include an air-assisted flue pipe 400 to assist the flow of exhaust gases from a burner into the center of a flue and/or chimney. Optionally, flue pipe 400 may be used in conjunction with a chimney exhaust collector/air recirculation system 450, as shown in FIGS. 31A and 31B.

Flue pipe 400 includes an inlet positioned to enable the exhaust gases from the burner to flow into the pipe as they would in a standard flue pipe. Once inside the pipe, compressed or forced air from air inlet openings 402 directs the exhaust gases into the center of the flue pipe or chimney. In one preferred embodiment of this invention, flue pipe 400 includes a cylinder 404 that contains two air inlet lines 406 fed by a main air line. As shown in FIG. 30B, air inlet line 406 includes a fitting/connector 408, mounting bracket 410 and interior air line 412. Interior air line 412 draws the exhaust fumes into the center of the flue or chimney to enable the collection of a portion of the fumes with system 450. FIG. 30C shows the components mounted and fastened on flue pipe 400. In one embodiment of flue pipe 400, the exhaust gases are directed out an associated or connected chimney. In another embodiment, a portion of the exhaust gases are directed into system 450 and redirected back into a compressor.

Figure 31A:
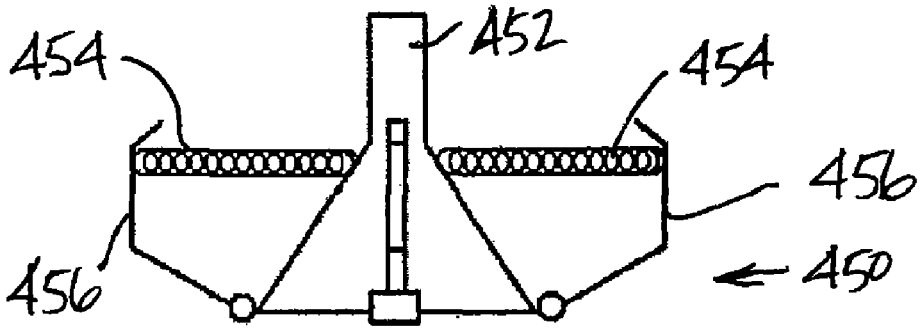
FIGS. 31A and 31B show a funnel-type chimney exhaust collector/air recirculating system, according to one preferred embodiment of this invention.
Figure 31B:
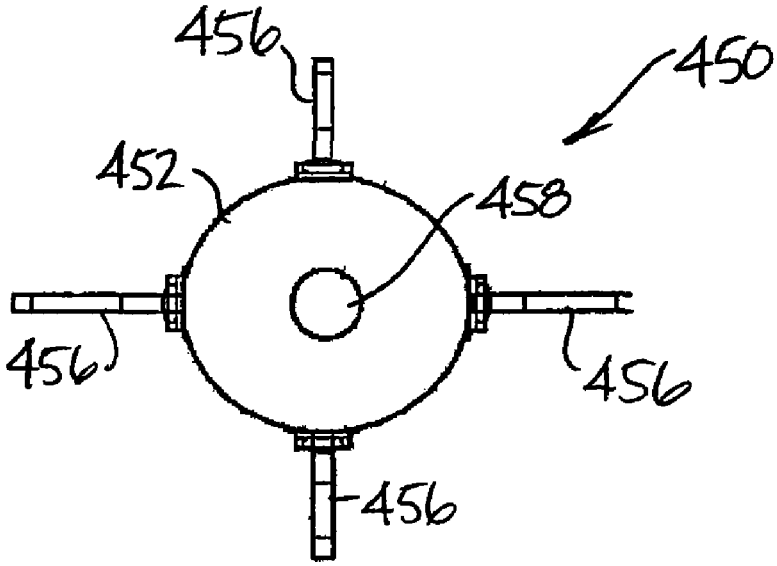

As shown in FIGS. 31A and 31B, funnel-type chimney exhaust collector/air recirculation system 450 directs a portion of the exhaust gases delivered to the center of the flue pipe or chimney back into the compressor to enable a section of the flue and/or chimney to remain open.

System 450 includes a funnel-shaped device 452 that has a smaller diameter opening at a first end portion and a larger diameter opening at an opposing second end portion. Device 452 includes compression springs 454 to provide an outward pressure on stabilizer arms 456. Device 452 may be inserted into a chimney and then held in place by extending stabilizer arms 456 outwardly, as shown in FIG. 31B. Prior to installing device 452 in the chimney, a recirculation line is attached with a connection or fastener within center opening 458. The line is fed out of the chimney or back through the chimney and then connected to the air compressor that feeds the valve assembly. A filter may be used to remove particulates prior to the recirculation of the exhaust gases back into the compressor. While a cylindrical collector is shown in FIGS. 31A and 31B, the collector may be any suitable shape, such as a square, rectangle, or other form that enables the flow of exhaust gases up the chimney as well as into the collector.

System 40 may include other suitable systems, devices and/or components, such as those disclosed in U.S. Pat. No. 6,314,949 to DeGrazia, Jr. et al., which is incorporated by reference herein and is made a part hereof.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A valve assembly comprising:

a block forming a bore;

an air inlet opening in communication with the bore, the air inlet opening providing a volume of air into the bore;

at least one air outlet passage including an air outlet end portion, the bore providing communication between the air inlet opening and the at least one air outlet passage;

a fuel inlet opening in communication with the bore, the fuel inlet opening providing a volume of fuel into the bore;

at least one fuel outlet passage, the bore providing communication between the fuel inlet opening and the at least one fuel outlet passage;

a pintle slidably positionable within the bore, the pintle controlling at least one of the volume of air directed out of the bore through the air outlet passage and the volume of fuel directed out of the bore through the fuel outlet passage; and wherein the air outlet end portion is angled to create an air flow path that includes at least one centripetal vortex.

2. The valve assembly of claim 1 wherein the pintle is movable within the bore between an initial position preventing communication between at least one of the bore and the at least one air outlet passage and the bore and the at least one fuel outlet passage, and an actuated position providing communication between at least one of the bore and the at least one air outlet passage and the bore and the at least one fuel outlet passage.

3. The valve assembly of claim 1 wherein the pintle is actuatable to move within the bore, and upon actuation of the pintle the volume of air and the volume of fuel enter the bore simultaneously.

4. The valve assembly of claim 1 wherein at least a portion of the pintle has a constant angle taper.

5. The valve assembly of claim 1 wherein the pintle further comprises an outer housing forming a second bore and a needle slidably positionable within the second bore.

6. The valve assembly of claim 5 further comprising a screw connected to the needle and adjusting a position of the needle within the second bore.

7. The valve assembly of claim 1 wherein the block comprises a plurality of removable modular blocks.

8. The valve assembly of claim 1 wherein the at least one fuel outlet passage is coaxial with the bore.

9. The valve assembly of claim 1 wherein the air outlet end portion of the at least one air outlet passage is angled toward the fuel outlet end portion of the at least one fuel outlet passage.

10. The valve assembly of claim 1 further comprising a retainer, with the pintle in an initial position, the retainer urging the pintle preventing communication between at least one of the bore and the air outlet passage and the bore and the fuel outlet passage.

11. The valve assembly of claim 1 further comprising a solenoid in actuating control communication with the pintle, the solenoid actuatable to move the pintle to an actuated position providing communication between the bore and the air outlet passage and the bore and the fuel outlet passage.

* * * * *